US008389195B2

(12) United States Patent
Tsubaki et al.

(10) Patent No.: US 8,389,195 B2
(45) Date of Patent: Mar. 5, 2013

(54) CAPSULE TONER AND METHOD OF MANUFACTURING CAPSULE TONER

(75) Inventors: Yoritaka Tsubaki, Osaka (JP); Yoshitaka Kawase, Osaka (JP); Keiichi Kikawa, Osaka (JP); Yoshinori Mutoh, Osaka (JP); Takashi Hara, Osaka (JP); Yoshiaki Akazawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 297 days.

(21) Appl. No.: 12/881,412

(22) Filed: Sep. 14, 2010

(65) Prior Publication Data

US 2011/0070541 A1 Mar. 24, 2011

(30) Foreign Application Priority Data

Sep. 18, 2009 (JP) ..... P2009-218103

(51) Int. Cl.
*G03G 9/093* (2006.01)

(52) U.S. Cl. ..... 430/137.11; 430/137.1

(58) Field of Classification Search ..... 430/137.1, 430/137.11

See application file for complete search history.

(56) References Cited

U.S. PATENT DOCUMENTS

| | | | | |
|---|---|---|---|---|
| 5,571,652 | A | 11/1996 | Asano et al. | |
| 7,291,436 | B2 | 11/2007 | Nakamura et al. | |
| 2001/0033982 | A1 | 10/2001 | Ishikawa et al. | |
| 2005/0136354 | A1 | 6/2005 | Ueda et al. | |
| 2007/0065744 | A1 | 3/2007 | Ishikawa et al. | |
| 2009/0011356 | A1* | 1/2009 | Tomita et al. | 430/109.4 |
| 2009/0246672 | A1 | 10/2009 | Ishikawa et al. | |

FOREIGN PATENT DOCUMENTS

| | | |
|---|---|---|
| JP | 3-116052 | 5/1991 |
| JP | 04-120552 | 4/1992 |
| JP | 7-120965 | 5/1995 |
| JP | 2001-201891 | 7/2001 |
| JP | 2001-235894 | 8/2001 |
| JP | 2005-181539 | 7/2005 |
| JP | 2005-266546 | 9/2005 |
| JP | 2005-266565 | 9/2005 |
| JP | 2007-121473 | 5/2007 |
| JP | 2009-014757 | 1/2009 |
| JP | 2009-192957 | 8/2009 |

* cited by examiner

*Primary Examiner* — Hoa V Le
(74) *Attorney, Agent, or Firm* — Nixon & Vanderhye, P.C.

(57) ABSTRACT

A capsule toner achieving both low temperature fixability and hot offset resistance, and a method of manufacturing the capsule toner are provided. A capsule toner includes a toner base particle containing a binder resin and a colorant, and a resin coating layer formed on a surface of the toner base particle. The resin coating layer includes a film of plural fine resin particles having different complex viscosities. The plural fine resin particles include first fine resin particles having complex viscosity at a softening temperature of the toner base particles of $5.0\times10^2$ Pa·s or more and $1.0\times10^3$ Pa·s or less, and second fine resin particles having complex viscosity at a softening temperature of the toner base particles of $1.0\times10^4$ Pa·s or more and $1.0\times10^5$ Pa·s or less.

4 Claims, 6 Drawing Sheets

CAPSULE TONER AND METHOD OF MANUFACTURING CAPSULE TONER

CROSS-REFERENCE TO RELATED APPLICATION

This application claims priority to Japanese Patent Application No. 2009-218103, which was filed on Sep. 18, 2009, the content of which is incorporated herein by reference in its entirety.

BACKGROUND OF THE INVENTION

1. Field of the Invention

The present invention relates to a capsule toner and a method of manufacturing the capsule toner.

2. Description of the Related Art

In an image forming apparatus employing an electrophotography, a surface of an image carrier is uniformly charged by a charging section (charging step), the surface of the image carrier is exposed by an exposure section to dissipate an electric charge of an exposed part so that an electrostatic latent image is formed on the surface of the image carrier (exposure step). Subsequently, a toner composed of fine colored powder having an electric charge is adhered to the electrostatic latent image to be visualized (developing step), and thus obtained visible image is transferred to a recording medium such as paper (transfer step). Further, the visible image is fixed on the recording medium by a fixing section by applying heat and pressure, or other fixing method (fixing step). Through the steps as described above, the image is formed on the recording medium. In addition, cleaning of the image carrier is performed for removing the toner remaining on the surface (residual toner) of the image carrier without being transferred to the recording medium (cleaning step).

A toner to be used for such image formation is necessary to include a function required not only for the developing step but also for each step of the transfer step, the fixing step, and the cleaning step.

Examples of a fixing method of a toner include a heating fixing method of fixing a toner on a recording medium by heating and melting, and a pressure fixing method of fixing a toner on a recording medium by plastically deforming it with pressure. In the heating fixing method, in consideration of the simplification of a fixing device, image quality after fixation and the like, a heat roll fixing method using a heat roll as a heating medium to heat and melt a toner has often been used.

In the heat fixing method, a toner must be melted at as low temperature as possible and fixed to a recording medium. In recent years, requirement to low temperature fixability of a toner is increased particularly from the standpoint of energy saving. The requirement has been responded by decreasing a molecular weight of a binder resin contained in a toner and by adding a release agent to a toner, thereby decreasing a softening temperature of a toner.

However, those methods have the effect in low temperature fixability, but have the problem of decrease in blocking resistance that where a toner is allowed to stand under high temperature, the toner gets soft by heat and is liable to become massed together.

To overcome the problem, Japanese Unexamined Patent Publication JP-A 2005-266565 discloses a capsule toner comprising toner base particles containing a crystalline polyester resin, and a shell layer containing a noncrystalline resin (amorphous polymer). When the shell layer is formed on the surfaces of the toner base particles as in the capsule toner disclosed in JP-A 2005-266565, blocking resistance is improved, and the toner is difficult to become massed together under high temperature.

However, the toner disclosed in JP-A 2005-266565 does not consider complex viscosity of a resin contained in the shell layer. As a result, even in the case of using different kinds of plural resins as a resin constituting the shell layer, there is high possibility that complex viscosities of resins constituting the shell layer are the same level. Thus, a toner having a shell layer constituted of resins having the same level of complex viscosities has the problem that low temperature fixability and hot offset resistance are decreased.

SUMMARY OF THE INVENTION

An object of the invention is to provide a capsule toner that achieves both low temperature fixability and hot offset resistance, as well as a method of manufacturing the capsule toner.

The invention provides a capsule toner comprising:

a toner base particle comprising a binder resin and a colorant; and a resin coating layer formed on a surface of the toner base particle, the resin coating layer comprising a film of plural fine resin particles having different complex viscosities at a softening temperature of the toner base particle.

According to the invention, the capsule toner comprises a toner base particle comprising a binder resin and a colorant, and a resin coating layer formed on the surface of the toner base particle. The resin coating layer comprises a film of plural fine resin particles having different complex viscosities at a softening temperature of the toner base particle. Of the plural fine resin particles having different complex viscosities, fine resin particles having relatively low complex viscosity suppress low temperature offset in the case that temperature of a fixing roller surface is relatively low during fixing, and can improve low temperature fixability. On the other hand, fine resin particles having relatively high complex viscosity suppress high temperature offset in the case that temperature of a fixing roller surface is relatively high during fixing, and can improve hot offset resistance. As a result, the capsule toner having a resin coating layer comprising plural fine resin particles having different complex viscosities can achieve both low temperature fixability and hot offset resistance. When an image is formed using such a capsule toner, a good image free of image defect can be formed.

Further in the invention, it is preferable that the plural fine resin particles comprise:

first fine resin particles having a complex viscosity at a softening temperature of the toner base particle of $5.0\times10^2$ Pa·s or more and $1.0\times10^3$ Pa·s or less; and second fine resin particles having a complex viscosity at a softening temperature of the toner base particle of $1.0\times10^4$ Pa·s or more and $1.0\times10^5$ Pa·s or less, and a ratio ($\eta_2/\eta_1$) of the complex viscosity $\eta_2$ to the complex viscosity is $\eta_1$ is 10 or more and 200 or less, where $\eta_1$ denotes the complex viscosity at a softening temperature of the toner base particle of the first fine resin particles and $\eta_2$ denotes the complex viscosity at a softening temperature of the toner base particle of the second fine resin particles.

According to the invention, the plural fine resin particles comprise first fine resin particles having the complex viscosity at a softening temperature of the toner base particle of $5.0\times10^2$ Pa·s or more and $1.0\times10^3$ Pa·s or less, and second fine resin particles having the complex viscosity at a softening temperature of the toner base particle of $1.0\times10^4$ Pa·s or more and $1.0\times10^5$ Pa·s or less. A ratio ($\eta_2/\eta_1$) of the complex viscosity $\eta_2$ to the complex viscosity $\eta_1$ is 10 or more and 200 or less, where $\eta_1$ denotes the complex viscosity at a softening temperature of the toner base particle of the first fine resin particles and $\eta_2$ denotes the complex viscosity at a softening temperature of the toner base particle of the second fine resin particles. When the resin coating layer comprises the first fine resin particles and the second fine resin particles, having the complex viscosities at a softening temperature of the toner base particle, that is, at a temperature of the capsule toner during fixing, satisfying the above ranges, and the ratio of the complex viscosity $\eta_2$ to the complex viscosity $\eta_1$ satisfying the above range, a capsule toner achieving both low temperature fixability and hot offset resistance can stably be realized.

Further, the invention provides a method of manufacturing a capsule toner comprising a toner base particle comprising a binder resin and a colorant, and a resin coating layer formed on the surface of the toner base particle, the method comprising:

a fine resin particle adhering step of adhering plural fine resin particles having different complex viscosities at a softening temperature of the toner base particle to the surface of the toner base particle by fluidizing the toner base particles and the plural fine resin particles by using a rotary stirring apparatus comprising a rotary stirring section and a spraying section and rotating the rotary stirring section;

a spraying step of spraying a spray liquid being a liquid for plasticizing the toner base particle and the plural fine resin particles, to the toner base particle having the plural fine resin particles adhered thereto, in a fluidized state from the spraying section by continuing rotation of the rotary stirring section; and a film-forming step of forming a resin coating film on the surface of the toner base particle by continuing rotation of the rotary stirring section until the plural fine resin particles adhered to the toner base particle are softened and form a film.

According to the invention, the method of manufacturing a capsule toner comprises the fine resin particle adhering step, the spraying step and the film-forming step. In the fine resin particle adhering step, the plural fine resin particles are adhered to the surface of the toner base particle by fluidizing the toner base particle and the plural fine resin particles having different complex viscosities at a softening temperature of the base toner particles by using the rotary stirring apparatus comprising the rotary stirring section and the spraying section and rotating the rotary stirring section. In the spraying step, a spray liquid being a liquid for plasticizing the toner base particle and the plural fine resin particles is sprayed to the toner base particle having the plural fine resin particles adhered thereto, in a fluidized state from the spraying section by continuing rotation of the rotary stirring section. In the film-forming step, a resin coating film is formed on the surface of the toner base particle by continuing rotation of the rotary stirring section until the plural fine resin particles adhered to the toner base particle are softened and form a film.

In the fine resin particle adhering step, a resin coating layer comprising plural fine resin particles having different complex viscosities can be formed by using the plural fine resin particles having different complex viscosities as fine resin particles to be adhered to the surface of the toner base particle. The spray liquid sprayed to the toner base particle having the plural fine resin particles adhered thereto from the spraying section in the spraying step takes away heat of evaporation during vaporization. As a result, in the film-forming step, the toner base particle having the plural fine resin particles adhered thereto relieve heat generated by adding impact by the rotary stirring section, and can suppress the toner base particle having the plural fine resin particles adhered thereto from being undesirably heated at high temperature. This can prevent that fine resin particles having a relatively low complex viscosity become massed with each other and are locally present on the surface of the toner base particle, and can form a resin coating layer comprising fine resin particles having a relatively low complex viscosity and fine resin particles having a relatively high complex viscosity, uniformly dispersed therein. The capsule toner having such a resin coating layer can achieve both low temperature fixability and hot offset resistance. Therefore, when the capsule toner is used in image formation, good image free of image defect can be formed.

Further in the invention, it is preferable that the plural fine resin particles comprise:

first fine resin particles having the complex viscosity at a softening temperature of the toner base particle of $5.0\times10^2$ Pa·s or more and $1.0\times10^3$ Pa·s or less; and second fine resin particles having the complex viscosity at a softening temperature of the toner base particle of $1.0\times10^4$ Pa·s or more and $1.0\times10^5$ Pa·s or less, and a ratio ($\eta_2/\eta_1$) of the complex viscosity $\eta_2$ to the complex viscosity is $\eta_1$ is 10 or more and 200 or less, where $\eta_1$ denotes the complex viscosity at a softening temperature of the toner base particle of the first fine resin particles and $\eta_2$ denotes the complex viscosity at a softening temperature of the toner base particle of the second fine resin particles.

According to the invention, the plural fine resin particles having different complex viscosities comprise first fine resin particles having the complex viscosity at a softening temperature of the toner base particle of $5.0\times10^2$ Pa·s or more and $1.0\times10^3$ Pa·s or less, and second fine resin particles having the complex viscosity at a softening temperature of the toner base particle of $1.0\times10^4$ Pa·s or more and $1.0\times10^5$ Pa·s or less. A ratio ($\eta_2/\eta_1$) of the complex viscosity $\eta_2$ to the complex viscosity $\eta_1$ is 10 or more and 200 or less, where $\eta_1$ denotes the complex viscosity at a softening temperature of the toner base particle of the first fine resin particles and $\eta_2$ denotes the complex viscosity at a softening temperature of the toner base particle of the second fine resin particles. When the resin coating layer comprising fine resin particles which comprise the first fine resin particles and the second fine resin particles, having the complex viscosities at a softening temperature of the toner base particle, that is, at a temperature of the capsule toner during fixing, satisfying the above ranges, wherein the ratio of the complex viscosity $\eta_2$ to the complex viscosity $\eta_2$ satisfies the above range, is formed, a capsule toner achieving both low temperature fixability and hot offset resistance can be produced.

Further in the invention, it is preferable that the fine resin particle adhering step comprises:

a first mixing step of obtaining fine resin particle mixture by fluidizing the first fine resin particles and the second fine resin particles; and a second mixing step of adhering the fine resin particle mixture to the surfaces of the toner base particle by fluidizing the toner base particle and the fine resin particle mixture.

According to the invention, the fine resin particle adhering step comprises the first mixing step and the second mixing step. The first mixing step obtains the fine resin particle mixture by fluidizing the first fine resin particles and the second fine resin particles. The second mixing step adheres the fine resin particle mixture to the surface of the toner base particle by fluidizing the toner base particle and the fine resin particle mixture. After mixing the first fine resin particles and the second fine particles in the first mixing step, those fine resin particles and the toner base particle are mixed in the second mixing step. As a result, proportion between the amounts the first fine resin particles and the second fine resin particles, adhered to the surfaces of the individual toner base particles can be suppressed from varying, and the proportions of the first fine resin particles and the second fine resin particles, contained in the resin coating layer can be made uniform in the individual capsule toner particles. Consequently, a capsule toner comprising capsule toner particles having uniform low temperature fixability and hot offset resistance can be produced.

Further in the invention, it is preferable that the first fine resin particles are mixed in the first mixing step such that the amount of the first fine resin particles is 30% by weight or more and 70% by weight or less based on the total weight of the fine resin particle mixture.

According to the invention, the first fine resin particles are mixed in the first mixing step such that the amount of the first fine resin particles is 30% by weight or more and 70% by weight or less based on the total weight of the fine resin particle mixture. This can form a resin coating layer comprising the first fine resin particles in an amount of 30% by weight or more and 70% by weight or less based on the total weight of the fine resin particle mixture contained in the resin coating layer. The capsule toner having such a resin coating layer can further stably achieve low temperature fixability and hot offset resistance.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
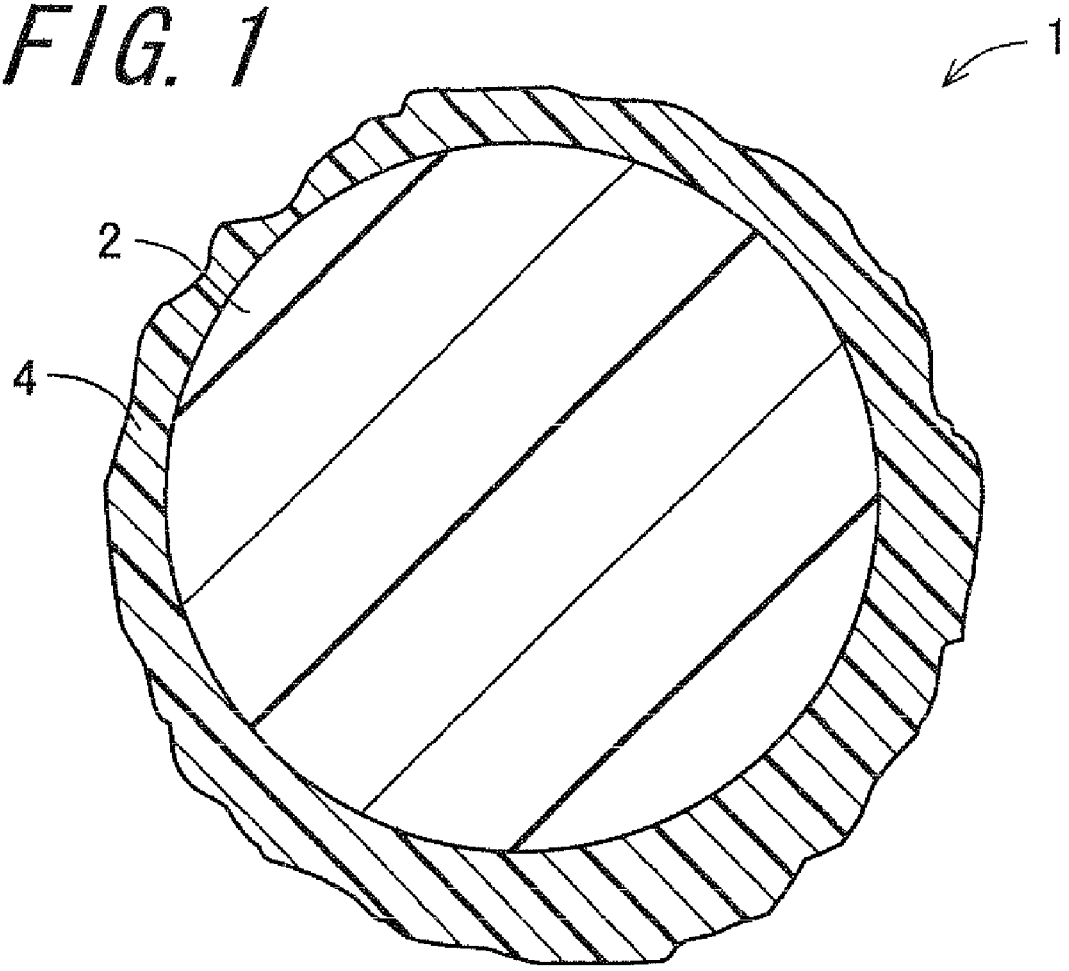
FIG. 1 is a cross-sectional view schematically showing the constitution of a capsule toner according to a first embodiment of the invention.

Now referring to the drawings, preferred embodiments of the invention are described below.

1. Capsule Toner

FIG. 1 is a cross-sectional view schematically showing the constitution of a capsule toner 1 according to a first embodiment of the invention. The capsule toner 1 of the embodiment comprises a toner base particle 2 and a resin coating layer 4 formed on the surface of the toner base particle 2. The resin coating layer 4 comprises plural fine resin particles having different complex viscosities at a softening temperature of the toner base particle 2.

Of the plural fine resin particles having different complex viscosities, fine resin particles having a relatively low complex viscosity suppress low temperature offset in the case that temperature of a fixing roller surface is relatively low during fixing, and can improve low temperature fixability. On the other hand, fine resin particles having a relatively high complex viscosity suppress high temperature offset in the case that temperature of a fixing roller surface is relatively high during fixing, and can improve hot offset resistance. As a result, the capsule toner 1 having a resin coating layer comprising plural fine resin particles having different complex viscosities can achieve both low temperature fixability and hot offset resistance. When an image is formed using such a capsule toner 1, a good image free of image defect can be formed.

(1) Toner Base Particle

The toner base particle 2 comprises a binder resin and a colorant, and may further comprise a release agent, a charge control agent and the like as other toner base particle component.

(Binder Resin)

The binder resin includes a polyester resin, and generally uses a material obtained by polycondensation using at least one selected from a divalent alcohol monomer and a trivalent or higher-valent polyalcohol monomer, and at least one selected from a divalent carboxylic acid monomer and a trivalent or higher-valent polycarboxylic acid monomer, as constituent monomers.

Examples of the divalent alcohol monomer include alkylene oxide adducts of bisphenol A, such as polyoxypropylene (2.2)-2,2-bis(4-hydroxyphenyl)propane, polyoxypropylene (3.3)-2,2-bis(4-hydroxyphenyl)propane, polyoxypropylene (2.0)-2,2-bis(4-hydroxyphenyl)propane, polyoxypropylene (2.0)-polyoxyethylene (2.0)-2,2-bis(4-hydroxyphenyl)propane, and polyoxypropylene (6)-2,2-bis(4-hydroxyphenyl) propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-nexanediol, 1,4-cyclohexane dimethanol, dipropylene glycol, polyethylene glycol, polypropylene glycol, polytetramethylene glycol, bisphenol A, propylene adduct of bisphenol A, ethylene adduct of bisphenol A and hydrogenated bisphenol A.

Examples of the trivalent or higher-valent polyalcohol monomer include sorbitol, 1,2,3,6-hexanetetrol, 1,4-sorbitan, pentaerythritol, dipentaerythritol, tirpentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethyl benzene.

In the embodiment, those divalent alcohol monomers and trivalent or higher-valent polyalcohol monomers may be used each alone, or two or more of them may be used in combination.

As an acid component, examples of the divalent carboxylic acid monomer include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, n-dodecylsuccinic acid, n-octylsuccinic acid, isooctenylsuccinic acid, isooctylsuccinic acid, and anhydrides or lower alkyl esters of those acids.

Examples of the trivalent or higher-valent polycarboxylic acid monomer include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, enpol trimer acid, and acid anhydrides or lower alkyl esters of those compounds.

In the embodiment, those divalent carboxylic acid monomers and trivalent or higher-valent polycarboxylic acid monomers may be used each alone, or two or more of them may be used in combination.

A method for producing a polyester in the embodiment is not particularly limited, and the polyester can be produced by esterification or ester exchange reaction using the above monomers.

(Colorant)

As the colorant, it is possible to use an organic dye, an organic pigment, an inorganic dye, an inorganic pigment or the like which is customarily used in the field of electrophotography.

Examples of black colorant include carbon black, copper oxide, manganese dioxide, aniline black, activated carbon, non-magnetic ferrite, magnetic ferrite, and magnetite.

Examples of yellow colorant include yellow lead, zinc yellow, cadmium yellow, yellow iron oxide, mineral fast yellow, nickel titanium yellow, navel yellow, naphthol yellow S, hanza yellow G, hanza yellow 100, benzidine yellow G, benzidine yellow GR, quinoline yellow lake, permanent yellow NCG, tartrazine lake, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, and C.I. Pigment Yellow 138.

Examples of orange colorant include red lead yellow, molybdenum orange, permanent orange GTR, pyrazolone orange, vulcan orange, indanthrene brilliant orange RK, benzidine orange G, indanthrene brilliant orange OK, C.I. Pigment Orange 31, and C.I. Pigment Orange 43.

Examples of red colorant include red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Examples of purple colorant includes manganese purple, fast violet B, and methyl violet lake.

Examples of blue colorant include Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. Pigment Blue 15, C.I. Pigment Blue 15:2, C.I. Pigment Blue 15:3, C.I. Pigment Blue 16, and C.I. Pigment Blue 60.

Examples of green colorant include chromium green, chromium oxide, pigment green B, malachite green lake, final yellow green G, and C.I. Pigment Green 7.

Examples of white colorant include those compounds such as zinc white, titanium oxide, antimony white, and zinc sulfide.

The colorants may be used each alone, or two or more of colorants having different colors may be used in combination. Furthermore, Two or more of colorants having the same color may be used in combination. Amount of the colorant used is not particularly limited, but is preferably from 0.1 to 20 parts by weight, and more preferably from 0.2 to 10 parts by weight, based on 100 parts by weight of the binder resin.

(Release Agent)

As the release agent, it is possible to use ingredients which are customarily used in the relevant field, including, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, etc.) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Note that examples of the derivatives include oxides, block copolymers of a vinylic monomer and wax, and graft-modified derivatives of a vinylic monomer and wax. A usage of the wax may be appropriately selected from a wide range without particularly limitation, and preferably 0.2 part by weight to 20 parts by weight, more preferably 0.5 part by weight to 10 parts by weight, and particularly preferably 1.0 part by weight to 8.0 parts by weight based on 100 parts by weight of the binder resin.

(Charge Control Agent)

As the charge control agent, it is possible to use charge control agents for controlling positive charge and for controlling negative charge ordinarily used in this field. Examples of the charge control agent for controlling positive charge include basic dyes, quaternary ammonium salts, quaternary phosphonium salts, aminopyrine, pyrimidine compounds, multinuclear polyamino compounds, aminosilane, nigrosine dyes and its derivative, triphenylmethane derivatives, guanidine salts and amidine salts. Examples of the charge control agent for controlling negative charge include oil-soluble dyes such as oil black and spirone black; metal-containing azo compounds, azo complex dyes, naphthenic acid metal salts, salicylic acid and metal complexes and metal salts of its derivative (metal is chromium, zinc, zirconium and the like), fatty acid soaps, long-chain alkyl carboxylic acid salts, and resin acid soaps. The charge control agents may be used each alone, or two or more of them may be used in combination as necessary. Amount of the charge control agent used is not particularly limited and can appropriately be selected from wide range. The charge control agent may be contained in the toner base particle 2, and may be used by mixing in a coating layer comprising the fine resin particles in a coating step described hereinafter. When the charge control agent is contained in the toner base particle 2, the charge control agent is used in an amount of preferably from 0.5 parts by weight to 3 parts by weight based on 100 parts by weight of the binder resin.

(2) Resin Coating Layer

The resin coating layer 4 comprises plural fine resin particles having different complex viscosities as described before. Specifically, the resin coating layer preferably comprises first fine resin particles having the complex viscosity at a softening temperature of the toner base particles 2 of $5.0\times10^2$ Pa·s or more and $1.0\times10^3$ Pa·s or less, and second fine resin particles having the complex viscosity at a softening temperature of the toner base particles 2 of $1.0\times10^4$ Pa·s or more and $1.0\times10^5$ Pa·s or less, and a ratio ($\eta_2/\eta_1$) of the complex viscosity $\eta_2$ to the complex viscosity $\eta_1$ is preferably 10 or more and 200 or less, where $\eta_1$ denotes the complex viscosity at a softening temperature of the toner base particles 2 of the first fine resin particles and $\eta_2$ denotes the complex viscosity at a softening temperature of the toner base particles 2 of the second fine resin particles.

The fine resin particles having the complex viscosity at a softening temperature of the toner base particles 2 of $5.0\times10^2$ Pa·s or more and $1.0\times10^3$ Pa·s or less have a sufficiently low complex viscosity during fixing. Therefore, the fine resin particles are easily compatible with the binder resin contained in the toner base particles 2, and are difficult to inhibit oozing of toner base particle components such as a release agent even in the case that temperature of a fixing roller is relatively low during fixing. For this reason, when the resin coating layer 4 contains the first fine resin particles (hereinafter referred to also as "low viscosity fine resin particles"), low temperature fixability can be improved.

The fine resin particles having the complex viscosity at a softening temperature of the toner base particles 2 of $1.0\times10^4$ Pa·s or more and $1.0\times10^5$ Pa·s or less have a sufficiently high complex viscosity during fixing. Therefore, a toner image is difficult to be adhered to the surface of a fixing roller even in the case that temperature of a fixing roller surface is relatively high. As a result, when the resin coating layer 4 contains the second fine resin particles (hereinafter referred to also as "high viscosity fine resin particles"), hot offset resistance can be improved. Furthermore, the fine resin particles having the complex viscosity at a softening temperature of the toner base particles 2 of $1.0\times10^4$ Pa·s or more and $1.0\times10^5$ Pa·s or less are difficult to be compatible with a binder resin contained in the toner base particles 2. When the resin coating layer 4 contains the high viscosity fine resin particles, the high viscosity rein fine particles have high effect of suppressing exposure of each component of toner base particles 2, thereby imparting heat resistance to the resin coating layer 4. Therefore, a capsule toner having the resin coating layer comprising the low viscosity fine resin particles and high viscosity fine resin particles achieves both low temperature fixability and hot offset resistance and can have sufficiently wide fixing temperature range, and additionally, blocking resistance that cannot be obtained by the toner base particles 2 alone can be obtained.

Fine resin particles having the complex viscosity at a softening temperature of the toner base particles 2 of less than $5.0\times10^2$ Pa·s are that cohesive force of capsule toner particles in a toner layer is too small during fixing. Therefore, the capsule toner 1 containing such fine resin particles is liable to cause high temperature offset. Furthermore, fine resin particles having the complex viscosity at a softening temperature of the toner base particles 2 exceeding $1.0\times10^3$ Pa·s are difficult to be compatible with the toner base particles 2 during fixing, and inhibit oozing of a release agent which is a toner base particle component. As a result, the capsule toner 1 containing such fine resin particles is liable to cause low temperature offset and high temperature offset.

The resin coating layer 4 containing the fine resin particles having the complex viscosity at a softening temperature of the toner base particles 2 of less than $1.0\times10^4$ Pa·s has low effect of suppressing exposure of each component of the toner base particles 2, and therefore is difficult to possess heat resistance. Furthermore, the fine resin particles having the complex viscosity at a softening temperature of the toner base particles 2 exceeding $1.0\times10^5$ Pa·s are difficult to be compatible with the toner base particles 2 during fixing even though used together with the low viscosity fine resin particles, and inhibit oozing of a release agent. Therefore, the capsule toner 1 containing such fine resin particles is liable to cause low temperature offset and high temperature offset.

When the ratio ($\eta_2/\eta_1$) of the complex viscosity $\eta_2$ to the complex viscosity $\eta_1$ is 10 or more and 200 or less, the capsule toner 1 achieving both low temperature fixability and offset resistance can further stably be realized. Where the ratio ($\eta_2/\eta_1$) of the complex viscosity $\eta_2$ to the complex viscosity $\eta_1$ is less than 10, width of complex viscosity of fine resin particles constituting the resin coating layer 4 is too small, and sufficient low temperature fixability and hot offset resistance may not be obtained. Where ratio ($\eta_2/\eta_1$) of the complex viscosity $\eta_2$ to the complex viscosity $\eta_1$ exceeds 200, width of complex viscosity of fine resin particles constituting the resin coating layer 4 is too large, and low temperature fixability and offset resistance may be decreased.

The complex viscosity of the fine resin particles was measured as follows. Viscoelasticity measuring instrument (trade name: VAR-100, manufactured by Rheologica Instruments, Inc.) was used, fine resin particles shaped into tablets having a height of 1 mm were set to a parallel plate having a diameter of 25 mm, temperature was elevated from 70° C. in a temperature rising rate of 3° C. per minute using a temperature rising method under conditions of frequency of 1 Hz and strain of 0.5, temperature rising was continued up to 150° C., and the complex viscosity was measured.

The resin coating layer 4 is preferably formed on a most part of the surface of the toner base particle 2. The term "most part of the surface of the toner base particle 2" means portion of 50% or more of a surface area of the toner base particle 2. Where the area of the toner base particle 2 of the portion on which the resin coating layer 4 is formed is less than 50% of the surface area of the toner base particle 2, exposure area of the toner base particle 2 is too large. As a result, low melting component such as a release agent contained in the toner base particle 2 is softened, and the capsule toner 1 may become massed together. For this reason, the area of the toner base particle 2 of the portion on which the resin coating layer 4 is formed is preferably from 50% to 100% of the surface area of the toner base particle 2.

The surface area of the toner base particle 2 can be calculated by considering the toner base particle 2 as a sphere and measuring an average particle size of the toner base particles 2. The area of the toner base particle 2 of the portion on which the resin coating layer 4 is formed can be calculated from an image taken by an electron microscope using, for example, an image analyzer.

In the case that the resin coating layer 4 is formed on most part of the surface of the toner base particle 2, the same effect as the case that the resin coating layer 4 is formed on the entire surface of the toner base particle 2 is obtained. Therefore, in the following description, the case that the resin coating layer 4 is formed on the entire surface of the toner base particle 2 is described as an example.

2. Method of Manufacturing Capsule Toner

Figure 2:
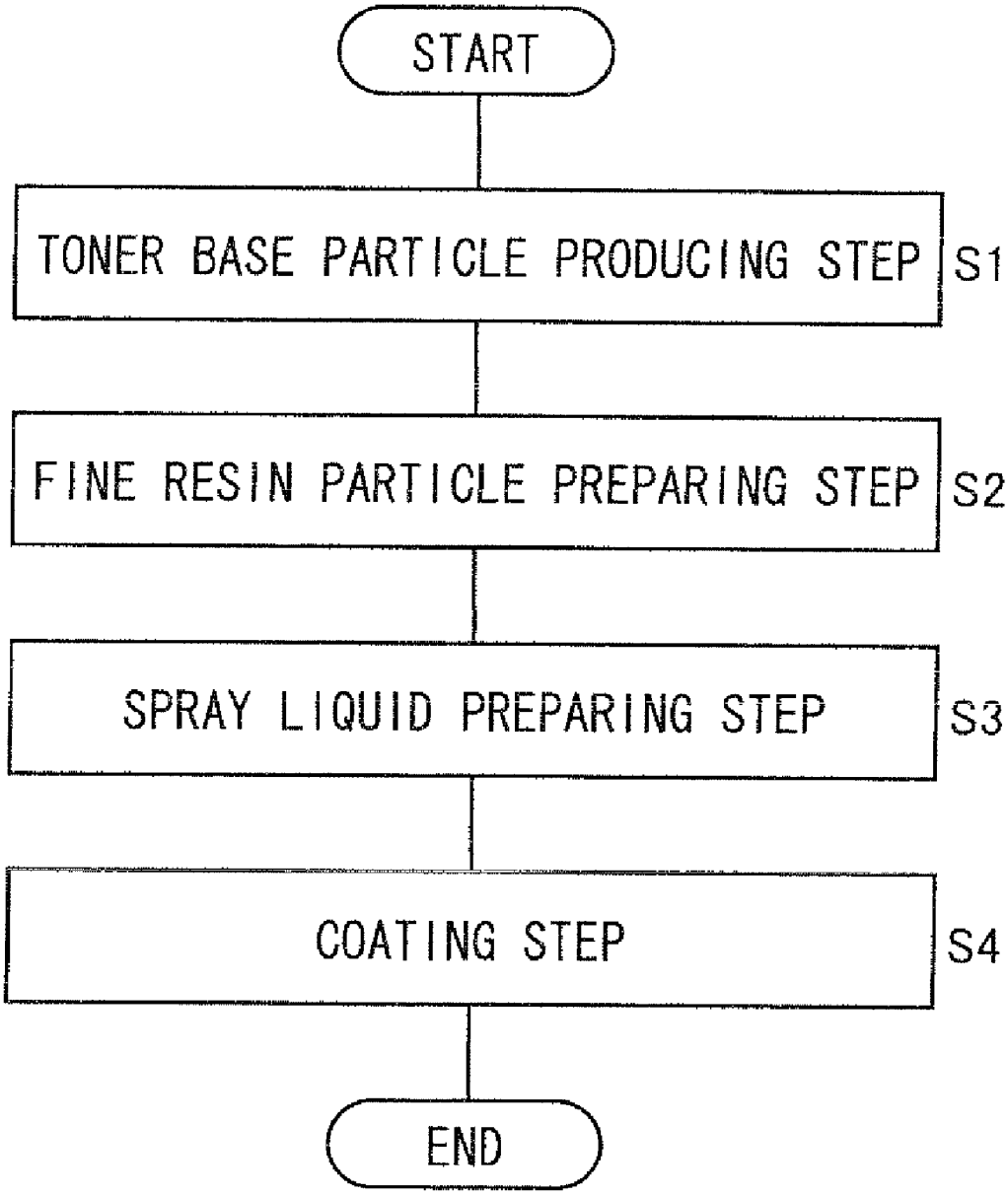
FIG. 2 is a flowchart showing a method manufacturing a capsule toner according to the first embodiment of the invention.

FIG. 2 is a flowchart showing a method of manufacturing a capsule toner according to a first embodiment of the invention. The method of manufacturing a capsule toner of the embodiment comprises a toner base particle producing step S1, a fine resin particle preparing step S2, a spray liquid preparing step S3 and a coating step S4.

(1) Toner Base Particle Producing Step

The toner base particle producing step S1 produces the toner base particles 2 each comprising a binder resin, a colorant and other toner base particle component.

The toner base particles 2 can be produced according to the general toner production method. The general toner manufacturing method includes a dry process such as a pulverization method, and a wet process such as a suspension polymerization method, an emulsion condensation method, a dispersion polymerization method, a dissolution suspension method and a melt emulsion method. The method of producing the toner base particles 2 by a pulverization method is described below.

In the pulverization method, a toner composition containing a binder resin, a colorant and other toner base particle component is dry mixed with a mixing machine, and then melt-kneaded with a kneading machine. A kneaded material obtained by melt-kneading is cooled and solidified, and a solidified material is pulverized with a pulverizer. Thereafter, as necessary, particle size is adjusted by, for example, classification, and the toner base particles 2 are obtained.

As the mixing machine, it is possible to use the conventional mixing machines. Examples of the mixing machine that can be used include Henschel type mixing apparatuses such as HENSCHEL MIXER (trade name, manufactured by Mitsui Mining Co., Ltd.), SUPERMIXER (trade name, manufactured by Kawata MFG Co., Ltd), and MECHANOMILL (trade name, manufactured by Okada Seiko Co., Ltd.); ANGMILL (trade name, manufactured by Hosokawa Micron Corporation); HYBRIDIZATION SYSTEM (trade name, manufactured by Nara Machinery Co., Ltd.); and COSMOSYSTEM (trade name, manufactured by Kawasaki Heavy Industries, Ltd.)

As the kneading machine, it is possible to use the conventional kneading machines, and ordinary kneading machines such as a twin-screw extruder, a three-roll mill and a laboplast mill can be used. Specific examples of the kneading machine that can be used include single-screw or twin-screw extruders such as TEM-100B (trade name, manufactured by Toshiba Machine Co., Ltd.), and PCM-65/87 and PCM-30 (trade names, manufactured by Ikegai, Ltd.); and open roll systems such as Kneadex (trade name, manufactured by Mitsui Mining Co., Ltd.)

Examples of the pulverizer that can be used include a jet type pulverizer that performs pulverization by utilizing supersonic jet stream, and a mechanical pulverizer that performs pulverization by introducing a solidified material into a space formed between a rotor rotating at high speed and a stator (liner).

The classification can use the conventional classifiers that can remove perpulverized toner base particles by classification due to centrifugal force and wind force, and can use, for example, a swing wind classifier (rotary wind classifier).

The toner base particle component such as a colorant may be used in a form of a masterbatch in order to uniformly disperse the component in a kneaded material. Furthermore, two or more of toner base particle components such as a colorant may be used in a form of composite particles. The composite particles can be produced by adding appropriate amounts of water, a lower alcohol and the like to two or more of the toner base particle components such as a colorant, granulating the resulting mixture with a general granulator such as a high-speed mill, and then drying. The masterbatch and the composite particles are mixed with a powder mixture when dry mixing.

The toner base particles 2 obtained have a volume average particle size of preferably from 3 μm to 10 μm, and more preferably from 5 μm to 8 μm. When the volume average particle size of the toner base particles 2 is from 3 μm to 10 μm, a high-definition image can stably be formed over a long period of time. Where the volume average particle size of the toner base particles 2 is less than 3 μm, a particle size of the toner base particles 2 is too small, and high charging and low fluidization may occur. When high charging and low fluidization are generated, the capsule toner 1 cannot stably be fed to a photoreceptor, and background fogging and decrease in image density may be generated. Where the average particle size of the toner base particles 2 exceeds 10 μm, the particle size of the toner base particles 2 is large, and as a result, a high-definition image cannot be obtained. Furthermore, with increasing the particle size of the toner base particles 2, specific surface area is decreased and charged amount of the capsule toner 1 becomes small. Where the charged amount of the capsule toner 1 is small, the capsule toner 1 cannot stably be fed to a photoreceptor, and inner contamination due to toner scattering may be generated.

(2) Fine Resin Particle Preparing Step

The fine resin particle preparing step S2 prepares plural fine resin particles having different complex viscosities, containing at least a resin. Specifically, the low viscosity fine resin particles and the high viscosity fine resin particles described before are prepared.

The complex viscosities of the low viscosity fine resin particles and the high viscosity fine resin particles can be adjusted by a molecular weight of a resin contained in the low viscosity fine resin particles and the high viscosity fine resin particles. The complex viscosity is increased with increasing the molecular weight of a resin. Therefore, the low viscosity fine resin particles and the high viscosity fine resin particles, having the complex viscosities of the above range can be prepared by appropriately adjusting, for example, polymerization temperature and polymerization time.

The low viscosity fine resin particles and the high viscosity fine resin particles are prepared by, for example, a phase inversion emulsion method on the basis of a polyester resin or a styrene-acryl copolymer resin. As the polyester, those obtained by polycondensation using at least one selected from divalent alcohol monomers and trivalent or higher-valent polyalcohol monomers, and at least one selected from divalent carboxylic acid monomers and trivalent or higher-valent polycarboxylic acid monomers, as constituent monomers, are generally used.

Examples of the divalent alcohol monomer include alkylene oxide adducts of bisphenol A, such as polyoxypropylene (2.2)-2,2-bis(4-hydroxyphenyl)propane, polyoxypropylene (3.3)-2,2-bis(4-hydroxyphenyl)propane, polyoxypropylene (2.0)-2,2-bis(4-hydroxyphenyl)propane, polyoxypropylene (2.0)-polyoxyethylene (2.0)-2,2-bis(4-hydroxyphenyl)propane, and polyoxypropylene (6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, bisphenol A, propylene adduct of bisphenol A, ethylene adduct of bisphenol A and hydrogenated bisphenol A.

Examples of the trivalent or higher-valent polyalcohol monomer include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethyl benzene.

In the embodiment, those divalent alcohol monomers and trivalent or higher-valent polyalcohol monomers may be used each alone, or two or more of them may be used in combination.

As an acid component, examples of the divalent carboxylic acid monomer include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, n-dodecylsuccinic acid, n-octylsuccinic acid, isooctenylsuccinic acid, isooctylsuccinic acid, and anhydrides or lower alkyl esters of those acids.

Examples of the trivalent or higher-valent polycarboxylic acid monomer include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, enpol trimer acid, and acid anhydrides or lower alkyl esters of those compounds.

In the embodiment, those divalent carboxylic acid monomers and trivalent or higher-valent polycarboxylic acid monomers may be used each alone, or two or more of them may be used in combination.

A method for producing a polyester in the embodiment is not particularly limited, and the polyester can be produced by esterification or ester exchange reaction using the above monomers.

As an acrylic resin monomer of the styrene-acryl copolymer resin, it is possible to use the conventional monomers, and examples thereof include acrylic acid having a substituent, methacrylic acid having a substituent, acrylic ester having a substituent and methacrylic ester having a substituent. Specific examples of the acrylic resin monomer include acrylic ester monomers such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate and dodecyl acrylate; methacrylic ester monomers such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate and dodecyl methacrylate; and hydroxyl group-containing (meth)acrylic ester monomers such as hydroxyethyl acrylate and hydroxypropyl methacrylate. The acrylic resin monomers may be used each alone, or two or more of them may be used in combination.

As the styrene monomer of the styrene-acrylic copolymer resin, one heretofore known can be used, and examples thereof include styrene and α-methyl styrene. The styrene monomers may be used each alone, or two or more of them may be used in combination. The polymerization of these monomers is performed by using a common radical initiator by solution polymerization, suspension polymerization, emulsification polymerization, or the like.

As described above, the low viscosity fine resin particles and the high viscosity fine resin particles are prepared by a phase inversion emulsion method on the basis of a polyester resin or a styrene-acryl copolymer resin. Thermal characteristics (glass transition temperature, complex viscosity and the like) of the polyester resin or styrene-acryl copolymer resin remain almost unchanged before and after the phase inversion emulsion method. For this reason, in the embodiment, complex viscosities of resins constituting the low viscosity fine resin particles and the high viscosity fine resin particles, respectively, are used as complex viscosities of the low viscosity fine resin particles and the high viscosity fine resin particles.

The low viscosity fine resin particles and the high viscosity fine resin particles can be obtained, for example, by emulsion dispersing the fine resin particle raw materials with a homogenizer or the like to form fine particles, or by polymerization of monomers.

The low viscosity fine resin particles preferably have a glass transition temperature of from 50° C. to 65° C., and a softening temperature of from 90° C. to 120° C. The high viscosity fine resin particles preferably have a glass transition temperature of from 55° C. to 70° C., and a softening temperature of from 100° C. to 130° C. Thus, the low viscosity fine resin particles and the high viscosity fine resin particles, having the complex viscosities in the ranges described above used in the embodiment have the tendency showing near glass transition temperature values, and further have the tendency showing near softening temperature values.

The low viscosity fine resin particles and the high viscosity fine resin particles preferably have a volume average particle size of from 0.05 μm to 1 μl. When the volume average particle size of the low viscosity fine resin particles and the high viscosity fine resin particles is from 0.05 μm to 1 μm, a homogeneous resin coating layer 4 can be formed. This makes easy for the capsule toner 1 to get caught on a cleaning blade when it is cleaned, and cleaning property is improved.

Where the volume average particle size of the low viscosity fine resin particles and the high viscosity fine resin particles is less than 0.05 μm, thickness of the resin coating layer 4 formed becomes small, making it difficult to control the thickness thereof. As a result, it is difficult to uniformly coat the surface of the toner base particles 2 with the resin coating layer, and toner characteristics such as fluidity, blocking resistance and charging stability may be deteriorated. Furthermore, height of projections formed becomes small, and cleaning property may be deteriorated. Additionally, a size of the fine resin particles becomes too small, and handling property of the fine resin particles is decreased.

Where the volume average particle size of the low viscosity fine resin particles and the high viscosity fine resin particles exceeds 1 μm, height of projections formed becomes large, and as a result, a proportion of the resin coating layer 4 in the capsule toner 1 is increased. Where the proportion of the resin coating layer 4 in the capsule toner 1 is large, influence of the resin coating layer 4 during the image formation becomes too large, and the desired image may not be formed, although depending on a material forming the resin coating layer 4.

(3) Spray Liquid Preparing Step

The spray liquid preparing step S3 prepares a spray liquid which increases adhesion between the toner base particles 2 and the fine resin particles by spraying the spray liquid to the toner base particles 2, and the low viscosity fine resin particles and the high viscosity fine resin particles (hereinafter collectively referred to also as "fine resin particles" for simplicity) to plasticize the toner base particles 2 and the fine resin particles.

The spray liquid having the effect of assisting adhesion between the toner base particles 2 and the fine resin particles and plasticizing those particles without dissolution is not particularly limited. However, the liquid must be removed from the toner base particles 2 and the fine resin particles after spraying the liquid. For this reason, liquid easy to vaporize is preferably used. Such a liquid includes a liquid containing lower alcohol. Examples of the lower alcohol include methanol, ethanol and propanol. When the liquid contains such lower alcohol, wettability of the fine resin particle as a coating material to the toner base particles 2 can be improved, and this facilitates adhesion of the fine resin particles to the entire surface or a most part of the surface of the toner base particle 2, and further facilitates deformation and film formation of the fine resin particles. The lower alcohol has large vapor pressure. Therefore, drying time when removing the spray liquid can be further shortened, and mass formation of the toner base particles 2 with each other can be suppressed.

Use of a spray liquid improving wettability of the fine resin particles to the toner base particles 2 and increasing adhesion between the toner base particles 2 and the fine resin particles facilitates formation of the resin coating layer 4 containing the fine resin particles on the entire surface or a most part of the surface of the toner base particle 2. The resin coating layer 4 thus formed is difficult to be peeled from the toner base particles 2 due to the presence of the fine resin particles that fusion-adhere to the toner base particles 2. This can prevent the resin coating layer 4 from peeling due to long-term use and present properties of the capsule toner 1 from changing.

The spray liquid preferably has viscosity of 5 cP or less. Preferred spray liquid having viscosity of 5 cP or less includes an alcohol. Examples of the alcohol include methyl alcohol and ethyl alcohol. Those alcohols have low viscosity and are easy to vaporize. Therefore, when the spray liquid contains an alcohol, a liquid having fine droplet diameter can be sprayed without increasing droplet diameter of the spray liquid sprayed from a spraying section described hereinafter. Furthermore, a spray liquid having a uniform droplet diameter can be sprayed. Droplet refining can further be accelerated by collision between the toner base particles 2 and the droplets. This uniformly wets the surface of the toner base particles 2 and the fine resin particles to make those particles blend with each other, and softens the fine resin particles by the synergistic effect with collision energy. As a result, the capsule toner 1 having excellent uniformity can be obtained.

Viscosity of the spray liquid is measured at 25° C. The viscosity of the spray liquid can be measured with, for example, a cone plate rotary viscometer.

(4) Coating Step

The coating step S4 fusion-adheres the fine resin particles to the toner base particles 2 using the spray liquid increasing adhesion between the toner base particles 2 and the fine resin particles. Thus, the toner base particles 2 are coated with the fine resin particles, thereby forming the resin coating layer 4.

Figure 3:
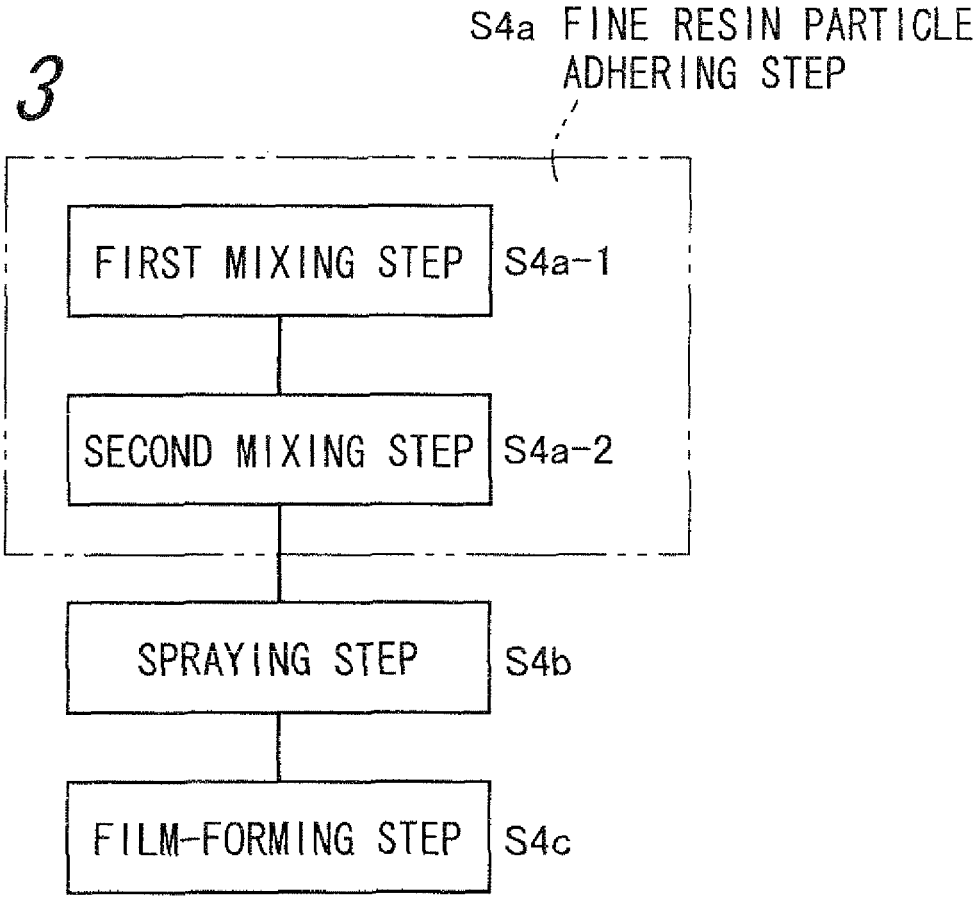
FIG. 3 is a flowchart showing a method of forming a resin coating layer on a surface of a toner base particle in a coating step.

FIG. 3 is a process chart showing a method of forming the resin coating layer 4 on the surfaces of the toner base particles 2 in the coating step S4. As shown in FIG. 3, the coating step S4 comprises a fine resin particle adhering step S4*a*, a spraying step S4*b* and a film-forming step S4*c*. The fine resin particle adhering step S4*a* comprises a first mixing step S4*a*-1 and a second mixing step S4*a*-2.

The coating step S4 is conducted using, for example, a surface modifying apparatus. The surface modifying apparatus is an apparatus comprising a container equipped with a stirring section for stirring the toner base particles 2 and the fine resin particles, and a spraying section for spraying a spray liquid into the container.

As the stirring section, it is possible to use, for example, a stirring rotor capable of imparting mechanical and thermal energy mainly comprising impact force to the toner base particles 2 and the fine resin particles.

As the container equipped with a stirring section, it is possible to use the commercially available containers. Examples of the container that can be used include Henschel type mixing apparatuses such as HENSCHEL MIXER (trade name, manufactured by Mitsui Mining Co., Ltd.), SUPER-MIXER (trade name, manufactured by Kawata MFG Co., Ltd), and MECHANOMILL (trade name, manufactured by Okada Seiko Co., Ltd.); ANGMILL (trade name, manufactured by Hosokawa Micron Corporation); HYBRIDIZATION SYSTEM (trade name, manufactured by Nara Machinery Co., Ltd.); and COSMOSYSTEM (trade name, manufactured by Kawasaki Heavy Industries, Ltd.). A liquid spraying unit is fitted in the container of such a mixing machine, and the mixing machine can be used as a surface modifying apparatus in the embodiment.

Figure 4:
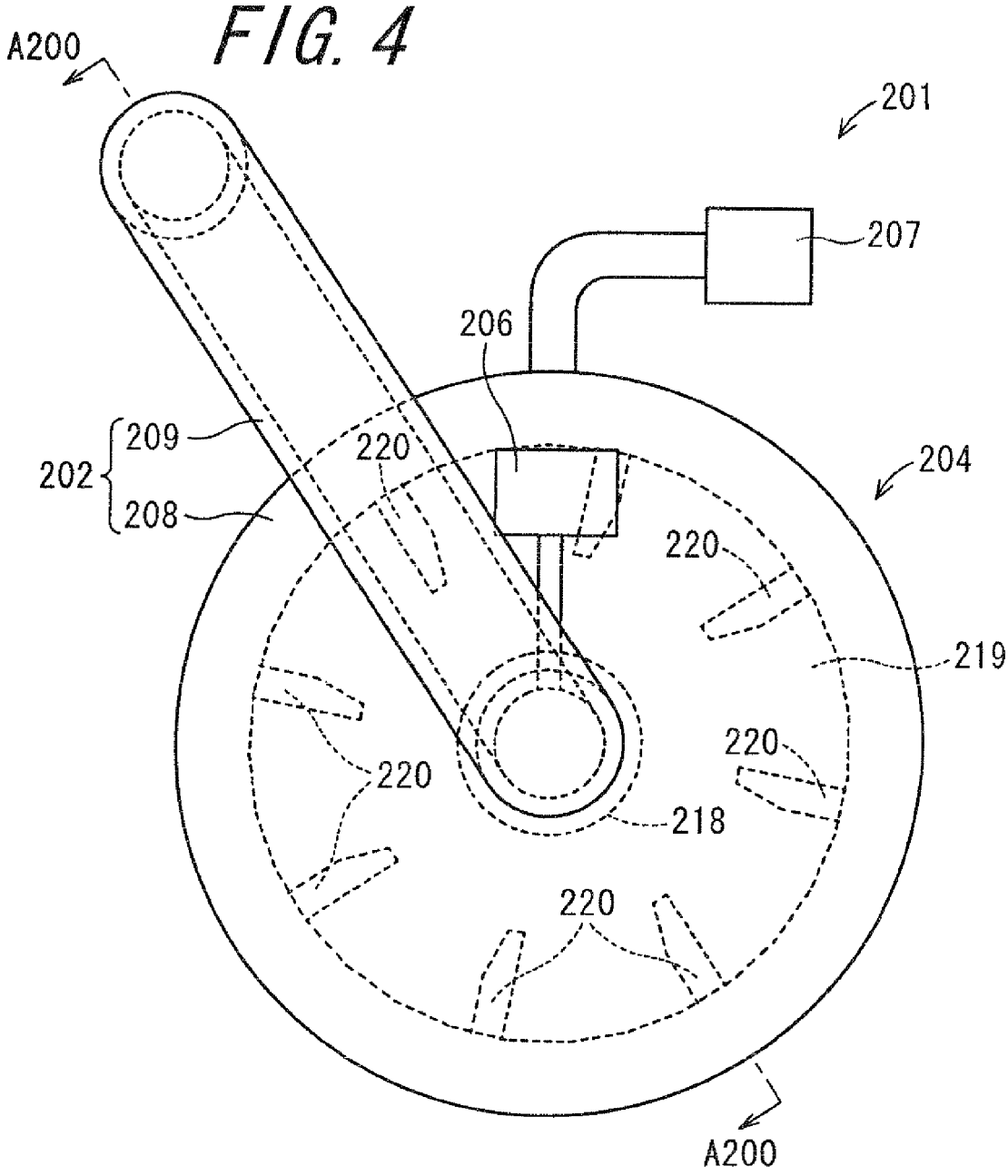
FIG. 4 is a front view showing the constitution of a rotary stirring apparatus which is one example of a surface modifying apparatus.
Figure 5:
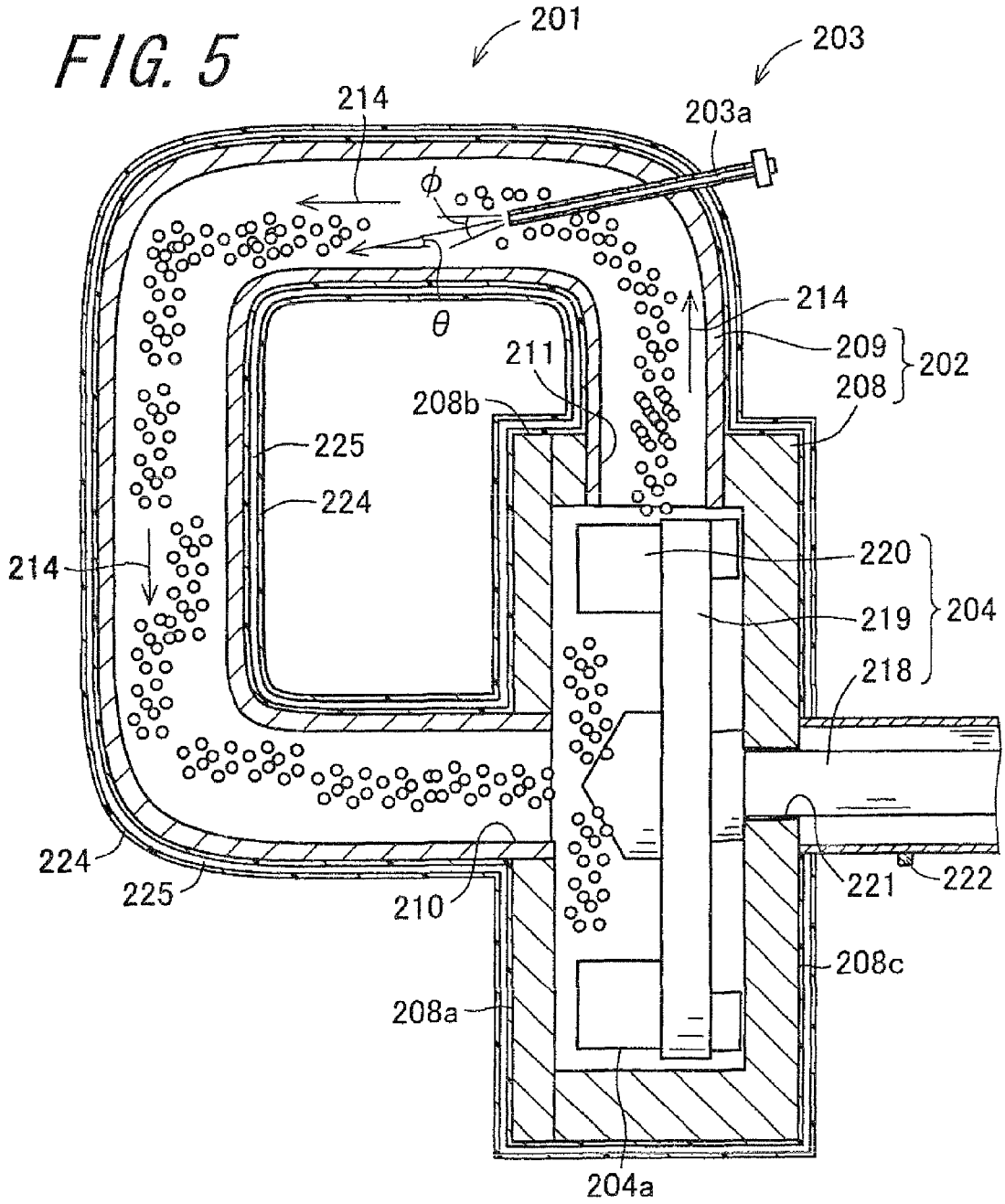
FIG. 5 is a schematic sectional view of the rotary stirring apparatus shown in FIG. 4 taken along the line A200-A200.

FIG. 4 is a front view showing the constitution of a rotary stirring apparatus 201 which is one example of the surface modifying apparatus. FIG. 5 is a schematic sectional view of the rotary stirring apparatus 201 shown in FIG. 4 taken along the line A200-A200. The rotary stirring apparatus 201 comprises a powder passage 202, a spraying section 203, a rotary stirring section 204, a temperature regulation jacket 224, a powder inputting section 206 and a powder collecting section 207.

The powder passage 202 comprises a rotary stirring chamber 208 and a circulation pipe 209. The rotary stirring chamber 208 is a nearly columnar container-like member having an internal space. The rotary stirring chamber 208 has openings 210 and 211 formed thereon. The opening 210 is formed so as to penetrate a side wall including a surface 208*a* of the rotary stirring chamber 208 in a thickness direction thereof in a nearly central part of the surface 208*a* at one side in an axial direction of the rotary stirring chamber 208. The opening 211 is formed so as to penetrate a side wall including a side surface 208*b* of the rotary stirring chamber 208 in a thickness direction thereof in the side surface 208*b* perpendicular to the surface 208*a* at one side in the axial direction of the rotary stirring chamber 208. One end of the circulation pipe 209 is connected to the opening 210, and the other end thereof is connected to the opening 211. By this constitution, the internal space of the rotary stirring chamber 208 is in communication with an internal space of the circulation pipe 209, thereby the power passage 202 is formed. The toner base particles 2, the fine resin particles and a gas flow through the powder passage in the mixing step. The powder inputting section 206 and the powder collecting section 207 are connected to the circulation pipe 209 of the powder passage 202.

The powder inputting section 206 comprises a hopper (not shown) for feeding the toner base particles 2 and the fine resin particles, a feed pipe in communication with the hopper and the powder passage 202, and a solenoid valve provided in the feed pipe. The toner base particles 2 and the fine resin particles, which are fed from the hopper, are fed to the powder passage 202 through the feed pipe in a state that the passage in the feed pipe is opened by the solenoid valve. The toner base particles 2 and the fine resin particles, which are fed to the powder passage 202, flow in a constant powder fluidizing direction by stirring with the rotary stirring section 204. The toner base particles 2 and the fine resin particles are not fed to the powder passage 202 in a state that the passage in the feed pipe is closed by the solenoid valve.

The powder collecting section 207 comprises a collecting tank, a collecting pipe in communication with the collecting tank and the powder passage 202, and a solenoid valve provided in the collecting pipe. Capsule toner particles flowing through the powder passage 202 are collected in the collecting tank through the collecting pipe in a state that passage in the collecting pipe is opened by the solenoid valve. The capsule toner particles flowing through the powder passage 202 are not collected in a state that passage in the collecting pipe is closed by the solenoid valve.

The rotary stirring section 204 comprises a rotary shaft 218, a discotic rotary disc 219, and a plurality of stirring blades 220. The rotary shaft 218 is a cylindrical-bar-shaped like member which rotates around an axis thereof by a motor (not shown) at a rotary shaft section (not shown) which is a section for driving the rotary shaft 218. The rotary shaft 218 is a cylindrical-bar-shaped member having an axis matching an axis of the rotary stirring chamber 208, that is provided so as to be inserted in a through-hole 221 which is formed to penetrate a side wall including a surface 208*c* at the other side in an axial direction of the rotary stirring chamber 208 in a thickness direction thereof, and that is rotated around an axis by a motor (not shown). The rotary disc 219 is a discotic member supported by the rotary shaft 218 so as to match the axis of the rotary shaft 218, and that rotates with rotation of the rotary shaft 218. The plurality of stirring blades 220 are supported by the rotary disc 219 and are rotated with rotation of the rotary disc 219.

Rotation speed of the rotary stirring section 204 is set such that a peripheral speed at the outermost periphery is 50 m/sec or more. The "outermost periphery of the rotary stirring section 204" is a part of the rotary stirring section 204 having the longest distance to an axis of the rotary shaft 218 in a direction perpendicular to an extending direction of the rotary shaft 218 of the rotary stirring section 204. The peripheral speed at the outermost periphery of 50 m/sec or more can simultaneously achieve isolation fluidization of the toner base particles 2 and the fine resin particles and reduction of collision frequency of the toner base particles 2 and the fine resin particles to a passage inner wall. Where the peripheral speed at the outermost periphery is less than 50 m/sec, the toner base particles 2 and the fine resin particles cannot be isolation-fluidized. As a result, the resin coating layer 4 cannot stably be formed on the toner base particles 2.

The rotation number of the rotary stirring section 204 is appropriately changed according to a size of the rotary stirring section 204 so as to become the above rotation speed.

The temperature regulation jacket 224 as a temperature regulation section is provided on at least a part of the inner wall of the powder passage 202. The temperature regulation jacket 224 regulates the inner wall temperature of the powder passage 202 to be constant by flowing a medium such as water through a passage 225 formed in the inside thereof, thereby preventing the toner base particles 2 from adhering to the passage. The temperature regulation jacket 224 is preferably provided outside the part of the powder passage 202 to which the toner base particles 2 easily adhere. In the embodiment, the temperature regulation jacket 224 is provided at least on the entire circulation pipe 209 in the powder passage 202, on the rotary stirring chamber 208 and inside the inner wall of the rotary stirring chamber.

The spraying section 203 comprises a spray liquid reservoir (not shown) that reserves a spray liquid, a carrier gas storage section (not shown) for storing a carrier gas, and a liquid spraying unit 203*a* for mixing the spray liquid and the carrier gas, ejecting the mixture toward the toner base particles 2 and the fine resin particles which are fluidizing in the powder passage 202, and spraying droplets of the spray liquid to the toner base particles 2 and the fine resin particles.

As the carrier gas, compressed air or the like is usable. Preferred flow rate of the carrier gas depends on the spray velocity of a liquid differing depending on a scale of an apparatus and amounts of the toner base particles 2 and the fine resin particles, and is appropriately adjusted depending on the spray velocity of the spray liquid. As the liquid spraying unit, the commercially available units can be used, and, for example, a unit connected so as to constantly send a spray liquid to a two-fluid nozzle (trade name: HM-6 Model, manufactured by Fuso Seiki Co., Ltd.) through a liquid-sending pump (trade name: SP11-12, FLOM Co., Ltd.) can be used.

When the above rotary stirring apparatus 201 is used, use proportion between the toner base particles 2 and the fine resin particles is easily set, and it allows the resin coating layer 4 to have a suitable thickness. The rotary stirring apparatus 201 has the rotary stirring section 204 for stirring the toner base particles 2 in the powder passage 202. Therefore, a uniform amount of the fine resin particles can be adhered to the toner base particles 2, and the capsule toner 1 having uniform chargeability can be obtained.

Using the rotary stirring apparatus 201, the resin coating layer 4 is formed on the surfaces of the toner base particles 2 as follows.

Figure 6:
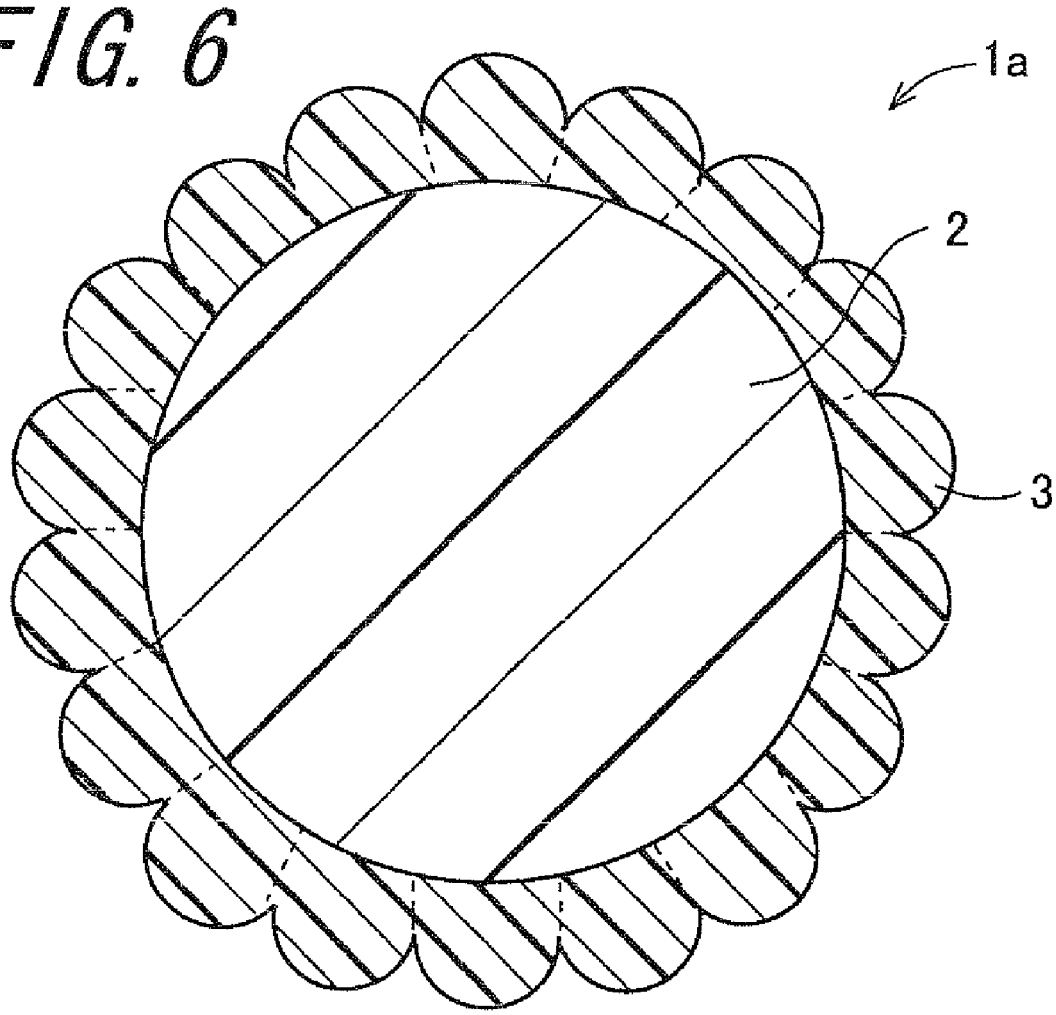
FIG. 6 is a sectional view schematically showing the constitution of the fine resin particle-adhered particle.

In the first mixing step S4*a*-1, low viscosity fine resin particles and high viscosity resin particles are introduced into the powder passage 202 from the powder inputting section 206, followed by fluidizing. Thus, fine resin particle mixture is obtained. In the second mixing step S4*a*-2, the toner base particles 2 and the fine resin particle mixture are fluidized, thereby adhering the fine resin particle mixture to the surfaces of the toner base particles 2. Thus, the fine resin particle-adhered particle 1*a* as shown in FIG. 6 is obtained. FIG. 6 is a sectional view schematically showing the constitution of the fine resin particle-adhered particle 1*a*. As shown in FIG. 6, the fine resin particle-adhered particle 1*a* comprises the toner base particle 2 having the fine resin particles 3 uniformly adhered to the surface thereof. The first mixing step S4*a*-1 may be conducted such that low viscosity fine resin particles and high viscosity fine resin particles are dispersed in a dispersion to prepare a 10 wt % suspension, and the suspension is dried with a spray drier.

The embodiment of mixing the low viscosity fine resin particles and the high viscosity fine resin particles in the first mixing step S4*a*-1 and then mixing those fine resin particles with the toner base particles in the second mixing step S4*a*-2 is preferred than the case that the toner base particles 2, the low viscosity fine resin particles and the high viscosity fine resin particles are simultaneously mixed. This embodiment can suppress variation of the proportion between the amount of the low viscosity fine resin particles and the amount of the high viscosity fine resin particles, adhered to the surfaces of the individual toner base particles 2. Therefore, ratio between the amount of the low viscosity fine resin particles and the amount of the high viscosity fine resin particles, contained in the resin coating layer 4 can be uniformed in individual capsule toner particles. As a result, the capsule toner 1, comprising capsule toner particles having uniform low temperature fixability and offset resistance can be produced.

The proportion of the fine resin particles used is not particularly limited, but is required to be the proportion with which the entire surfaces of the toner base particles 2 can be coated. The proportion of the fine resin particles used is preferably from 1 part by weight to 30 parts by weight based on 100 parts by weight of the toner base particles 2. When the fine resin particles are used in the proportion of this range, the fine resin particles can be adhered to the entire surfaces of the toner base particles 2, and the resin coating layer 4 can be formed on the entire surfaces of the toner base particles 2. This can surely prevent that low melting components contained in the toner base particles 2 ooze and the capsule toners 1 become massed together.

Where the proportion of the fine resin particles used is less than 1 part by weight, the entire surfaces of the toner base particles 2 may not be coated with the resin coating layer 4. Where the proportion of the fine resin particles used exceeds 30 parts by weight, the thickness of the resin coating layer 4 is too large, and fixability of the capsule toner 1 may be decreased depending on the constituent materials of the fine resin particles.

The low viscosity fine resin particles are preferably used in an amount of from 30% by weight to 70% by weight based on the total weight of the fine resin particle mixture. This can form the resin coating layer 4 containing the low viscosity fine resin particles in an amount of from 30% by weight to 70% by weight based on the total weight of the resin contained in the resin coating layer 4. The capsule toner 1 having the resin coating layer 4 can further stably achieve both low temperature fixability and hot offset resistance. Furthermore, it becomes possible to adjust blocking resistance effect that is not obtained in the toner base particles 2.

Where the amount of the low viscosity fine resin particles is less than 30% by weight, oozing of a release agent is deteriorated, and high temperature offset is liable to occur. Furthermore, the complex viscosity of the whole capsule toner 1 is too high during fixing at low temperature, and low temperature offset is liable to occur, as well. Where the amount of the low viscosity fine resin particles exceeds 70% by weight, the complex viscosity of the whole capsule toner 1 is too low in the case of fixing at high temperature, and high temperature offset is liable to occur. However, those values are one example, and in the case of using the toner base particles containing a binder resin having a relatively high melting point, the proportion of the low viscosity fine resin particles contained is increased, and in the case of using the toner base particles containing a binder resin having a relatively low melting point, the proportion of the low viscosity fine resin particles contained is decreased, and the proportion of the high viscosity fine resin particles contained is increased.

The spraying step S4*b* sprays the spray liquid to the fine resin particle-adhered particles in a fluidized state from the spraying section 203. The toner base particles 2 and the fine resin particles swell and soften their surfaces by that the spray liquid is sprayed and thermal energy by stirring is applied. Thus, wet particles are obtained.

The film-forming step S4*c* continues rotation of the rotary stirring section 204 until the fine resin particles on the surfaces of the wet particles soften and form a film while continuing spraying the spray liquid from the spraying section 203. When mechanical impact force by the rotary stirring section 204 is applied, the fine resin particles are fixed to the surfaces of the toner base particles 2, and additionally, a part of the fine resin particles are fused to at least one of the toner base particles and the adjacent fine resin particles. Thus, the fine resin particles are adhered to the entire surfaces of the toner base particles 2, the fine resin particles can be fused to the entire surfaces of the toner base particles 2, and can form a film thereon, and the resin coating layer 4 can be formed on the surfaces of the toner base particles 2.

The individual fine resin particles fuse to other fine resin particles in plural portions. Therefore, the fine resin particles are difficult to cause elimination from the resin coating layer 4. Furthermore, the resin coating layer 4 comprising the fine resin particles fuse to the toner base particles 2 in very many portions. Therefore, the resin coating layer 4 is difficult to cause peeling from the toner base particles 2. For example, peeling of the resin coating layer 4 from the toner base particles 2 due to stirring in a development container can be prevented, and properties of the capsule toner 1 can be prevented from changing due to a long-term use.

The amount of the spray liquid used is not particularly limited, but is preferably an amount to an extent of wetting the entire surfaces of the toner base particles 2. The amount of the spray liquid used is determined by the amount of the toner base particles 2 used. The amount of the spray liquid used can be adjusted by the spraying time, the number of spraying and the like by the spraying section 203. Therefore, a spraying amount per unit time by the spraying section 203 is set depending on an average particle size of the toner base particles 2, use proportion between the toner base particles 2 and the fine resin particles, materials of the toner base particles 2 and material of the fine resin particles, and the like. For example, spraying the spray liquid by the spraying section 203 is completed at the time when almost all of the fine resin particles in the powder passage 202 have adhered to the toner base particles 2.

The spraying amount per unit time by the spraying section 203 is preferably 0.5 g/min or more and 2.0 g/min or less.

The time for spraying the spray liquid is preferably 10 minutes or longer and 60 minutes or shorter. Where the time for spraying the spray liquid is shorter than 10 minutes and is too short, the fine resin particles cannot sufficiently be fused. On the other hand, the time for spraying the spray liquid exceeds 20 minutes, shape of the capsule toner 1 is liable to deform.

The spray liquid is preferably sprayed in a state that the fine resin particle-adhered particles float in the powder passage 202. When the spray liquid is sprayed in a state that the fine resin particle-adhered particles float in the powder passage 202, time when the fine resin particle-adhered particles having the spray liquid sprayed thereto contact with each other can be shortened, and aggregation of the fine resin particle-adhered particles is prevented. As a result, formation of coarse particles is prevented, and the capsule toner 1 having uniform particle size can be obtained. The state that the fine resin particle-adhered particles float in the powder passage 202 can be realized by, for example, stirring with the rotary stirring section 204 and feeding a carrier gas.

Temperature in the powder passage 202 is preferably lower than a glass transition temperature of the binder resin contained in the toner base particles 2. The temperature can prevent aggregation of the toner base particles 2, generated by that the toner base particles 2 excessively melt in the powder passage 202 during the production of a capsule toner. Where the temperature in the powder passage 202 is equal to or higher than a glass transition temperature of the binder resin contained in the toner base particles 2, the toner base particles 2 excessively melt in the powder passage 202, and aggregation of the toner base particles 2 may occur.

The spray liquid sprayed from the spraying section 203 in the spraying step S4*b* absorbs heat of evaporation when vaporizing. Therefore, in the film-forming step S4*c*, the spray liquid relieve heat generated in wet particles by applying impact by the rotary stirring section 204, thereby suppressing the wet particles from being heated at undesirably high temperature. This can prevent the fine resin particles having a relatively low complex viscosity from aggregating and being locally present on the surfaces of the toner base particles 2, and can form the resin coating layer 4 comprising the fine resin particles having a relatively low complex viscosity and the fine resin particles having a relatively high complex viscosity, uniformly dispersed therein. The capsule toner 1 having the resin coating layer 4 can achieve both low temperature fixability and hot offset resistance. As a result, when the capsule toner 1 is used in image formation, a good image free of image defect can be formed.

To surely suppress that temperature in the powder passage 202 becomes undesirably high, the inside of the powder passage 202 of the rotary stirring apparatus 201 is preferably cooled with the temperature regulation jacket 224 as necessary.

After completion of the film formation of the fine resin particles on the entire surface of the toner base particles 2, the spray liquid is removed. The spray liquid is removed by evaporating the spray liquid with air current. In this case, when an alcohol is used as the spray liquid, the alcohol has large vapor pressure, and its removal and drying are easy.

The capsule toner 1 thus obtained maintains a fixing region of the toner base particles 2 by the fine resin particles fused to the toner base particles 2, and additionally, excellent blocking resistance that is the characteristic that has not been obtained by the toner base particles 2 is obtained.

External additives may be added to the capsule toner 1. As the external additives, it is possible to use the conventional external additives, and examples thereof include silica and titanium oxide. Those external additives are preferably surface-treated with a silicone resin, a silane coupling agent or the like. The amount of the external additives used is preferably from 1 to 10 parts by weight based on 100 parts by weight of the capsule toner 1.

The capsule toner 1 preferably has a volume average particle size of 5.0 μm or more and 9.0 μm or less, and a coefficient of variation of less than 30. Particle size distribution of the capsule toner 1 becomes monodispersion as the coefficient of variation of the capsule toner 1 is decreased. Therefore, a small coefficient of variation is preferred. However, in the case that the toner base particles 2 are particles prepared by a pulverization method, it is difficult for the capsule toner 1 to have the coefficient of variation of 20 or less.

The capsule toner 1 can be used as a one-component developer or a two-component developer. In the case of using as a one-component developer, the capsule toner 1 is used alone without using a carrier. Furthermore, in the case of using as a one-component developer, the capsule toner 1 is conveyed by frictionally charging the capsule toner 1 with a development sleeve using a blade and a fur brush and adhering the capsule toner 1 to the sleeve, and image formation is conducted.

In the case of using as a two-component developer, the capsule toner 1 is used together with a carrier. As the carrier, it is possible to use the conventional carriers, and examples of the carrier that can be used include single or composite ferrite comprising iron, copper, zinc, nickel, cobalt, manganese, chromium or the like, and carrier core particles surface-coated with a coating material.

As the coating material, it is possible to use the conventional coating materials, and examples of the coating material that can be used include polytetrafluoroethylene, monochlorotrifluoroethylene polymer, polyvinylidene fluoride, silicone resin, polyester, metal compound of di-tertiary butylsalicylic acid, styrenic resin, acrylic resin, polyamide, polyvinyl butyral, nigrosine, aminoacrylate resin, basic dye, lake product of basic dye, silica fine powder and alumina powder. The coating material is preferably selected depending on a toner component. The coating materials may be used each alone, or two or more of them may be used in combination. The carrier has an average particle size of preferably from 10 to 100 μm, and more preferably from 20 to 50 μm.

The two-component developer contains the capsule toner 1 having the effect as described above, and therefore has stability with the passage of time such as fixability and chargeability. In addition, the two-component developer can form a high-definition image at high concentrations.

EXAMPLES

Complex Viscosity of Fine Resin Particles

Complex viscosity of the fine resin particles was measured as follows. Using a viscoelasticity measuring instrument (trade name: VAR-100, manufactured by Rheologica Instruments), a resin constituting the fine resin particles, shaped into a tablet having a height of 1 mm was set to a parallel plate having a diameter of 25 mm. Temperature was increased from 70° C. in a temperature rising rate of 3° C. per minute using a temperature rising method under the conditions of frequency of 1 Hz and strain of 0.5, the temperature rising was continued up to 150° C., and complex viscosity was then obtained.

[Softening Temperature of Toner Base Particles]

Fluidity characteristic evaluation apparatus (trade name: FLOW TESTER CFT-100C, manufactured by Shimadzu Corporation) was set such that when a load of 20 kgf/cm$^2$ ($19.6\times10^5$ Pa) is given, 1 g of a sample is extruded from a die (nozzle bore: 1 mm, length: 1 mm). Heating was conducted in a temperature rising rate of 6° C. per minute, and temperature when a half amount of a sample is flown out of the die was obtained. The temperature was used as a softening temperature (Tm).

[Volume Average Particle Size and Coefficient of Variation of Capsule Toner]

To 50 ml of an electrolyte (trade name: ISOTON-II, manufactured by Beckman Coulter, Inc.), 20 mg of a capsule toner and 1 ml of sodium alkyl ether sulfate (dispersant, manufactured by Kishida Chemical Co., Ltd.) were added, followed by dispersion treatment with an ultrasonic homogenizer (trade name: UH-50, manufactured by SMT) at ultrasonic frequency of 20 kHz for 3 minutes, and the resulting product was used as a measurement sample. Using the measurement sample, a particle size of capsule toner particles was measured under the conditions of an aperture diameter of 20 μm and the number of measurement particles of 50000 counts using a particle size distribution measuring instrument (trade name: Multisizer 3, manufactured by Beckman Coulter, Inc.). Volume particle size distribution of capsule toner particles was obtained from the measurement result obtained, and a volume average particle size (μm) of a capsule toner was calculated from the volume particle size distribution obtained. Furthermore, standard deviation in the volume particle size distribution was obtained, and a coefficient of variation (CV value, %) of a capsule toner was calculated based on the following expression (1):

$$\text{CV value (\%)}=\{\text{Standard deviation in volume particle size distribution/Volume average particle size (μm)}\}\times100 \quad (1)$$

[Production of Toner Base Particles]

With a Henschel mixer, 85 parts by weight of a polyester resin (trade name: TUFFTON, manufactured by Kao Corporation, glass transition temperature: 60° C., softening temperature: 120° C.), 5 parts by weight of copper phthalocyanine (C.I. Pigment Blue 15:3) as a colorant, 8 parts by weight of a release agent (carnauba wax, manufactured by Toakasei Co., Ltd., melting point: 82° C.) and 2 parts by weight of a charge control agent (trade name: BONTRON E84, manufactured by Orient Chemical Industries, Ltd.) were mixed and dispersed for 3 minutes to obtain toner base particle mixture. The toner base particle mixture obtained was melt-kneaded and dispersed with a twin-screw extruder (trade name: PCM-20, manufactured by Ikegai). Thus, a resin kneaded material was obtained.

The resin kneaded material obtained was cooled with a cooling belt, and then roughly pulverized with a speed mill having a screen having a diameter of 2 mm. The roughly pulverized material obtained was pulverized with a jet type pulverizer (trade name: IDS-2, manufactured by Nippon Pneumatic Mfg Co., Ltd.), and then fine particles and coarse particles were removed with an Elbow-Jet Classifier (trade name, manufactured by Nittetsu Mining Co., Ltd.) Thus, toner base particles having a volume average particle size of 6.9 μm and a coefficient of variation of 22 were obtained.

[Production of Fine Resin Particles]

<Fine resin particle A>

Polyester resin A (glass transition temperature: 58° C., softening temperature: 100° C., weight average molecular weight: 12500, complex viscosity at 120° C.: $8.0\times10^2$ Pa·s) was dissolved in methyl ethyl ketone, the resulting solution was mixed with an ammonia aqueous solution, and the resulting mixture was emulsified with a mechanical disperser (trade name: CLEARMIX, manufactured by M Technique Co., Ltd.) Methyl ethyl ketone was distilled away from the emulsified material obtained under reduced pressure. Thus, fine resin particles A having a volume average particle size of 0.1 μm were obtained.

<Fine Resin Particle B>

Fine resin particles B having a volume average particle size of 0.1 μm were obtained in the same manner as for the fine resin particles A, except for using polyester resin B (glass transition temperature: 65° C., softening temperature: 124° C., weight average molecular weight: 21400, complex viscosity at 120° C.: $4.0\times10^4$ Pa·s) in place of the polyester resin A.

<Fine Resin Particle C>

Fine resin particles C having a volume average particle size of 0.1 μm were obtained in the same manner as for the fine resin particles A, except for using polyester resin C (glass transition temperature: 61° C., softening temperature: 114° C., weight average molecular weight: 16600, complex viscosity at 120° C.: $5.0\times10^3$ Pa·s in place of the polyester resin A.

<Fine Resin Particle D>

Fine resin particles D having a volume average particle size of 0.1 μm were obtained in the same manner as for the fine resin particles A, except for using polyester resin D (glass transition temperature: 56° C., softening temperature: 94° C., weight average molecular weight: 10300, complex viscosity at 120° C.: $4.5\times10^2$ Pa·s) in place of the polyester resin A.

<Fine Resin Particle E>

Fine resin particles E having a volume average particle size of 0.1 μm were obtained in the same manner as for the fine resin particles A, except for using polyester resin E (glass transition temperature: 60° C., softening temperature: 104° C., weight average molecular weight: 13100, complex viscosity at 120° C.: $1.2\times10^3$ Pa·s) in place of the polyester resin A.

<Fine Resin Particle F>

Fine resin particles F having a volume average particle size of 0.1 μm were obtained in the same manner as for the fine resin particles A, except for using polyester resin F (glass transition temperature: 63° C., softening temperature: 120° C., weight average molecular weight: 19000, complex viscosity at 120° C.: $9.5\times10^3$ Pa·s) in place of the polyester resin A.

<Fine Resin Particle G>

Fine resin particles G having a volume average particle size of 0.1 μm were obtained in the same manner as for the fine resin particles A, except for using polyester resin G (glass transition temperature: 70° C., softening temperature: 131° C., weight average molecular weight: 25300, complex viscosity at 120° C.: $1.2\times10^5$ Pa·s) in place of the polyester resin A.

<Fine Resin Particle H>

Fine resin particles H having a volume average particle size of 0.1 μm were obtained in the same manner as for the fine resin particles A, except for using polyester resin H (glass transition temperature: 68° C., softening temperature: 128° C., weight average molecular weight: 23800, complex viscosity at 120° C.: $1.0\times10^5$ Pa·s) in place of the polyester resin A.

<Fine Resin Particle I>

Fine resin particles I having a volume average particle size of 0.1 were obtained in the same manner as for the fine resin particles A, except for using polyester resin I (glass transition temperature: 63° C., softening temperature: 121° C., weight average molecular weight: 20500, complex viscosity at 120° C.: $1.0\times10^4$ Pa·s) in place of the polyester resin A.

Properties of the fine resin particles A to I obtained are shown in Table 1.

TABLE 1

| Fine resin particle | Complex viscosity (Pa · s) | Glass transition temperature (° C.) | Softening temperature (° C.) | Weight average molecular weight |
|---|---|---|---|---|
| A | $8.0\times10^2$ | 58 | 100 | 12500 |
| B | $4.0\times10^4$ | 65 | 124 | 21400 |
| C | $5.0\times10^3$ | 61 | 114 | 16600 |
| D | $4.5\times10^2$ | 56 | 94 | 10300 |
| E | $1.2\times10^3$ | 60 | 104 | 13100 |
| F | $9.5\times10^3$ | 63 | 120 | 19000 |
| G | $1.2\times10^5$ | 70 | 131 | 25300 |
| H | $1.0\times10^5$ | 68 | 128 | 23800 |
| I | $1.0\times10^4$ | 63 | 121 | 20500 |

Example 1

In Example 1, the fine resin particles A were used as low viscosity fine resin particles, and the fine resin particles B were used as high viscosity fine resin particles.

Then, 10 wt % suspension obtained by dispersing 5 parts by weight of the fine resin particles A and 5 parts by weight of the fine resin particles B was dried with a spray drier. Thus, fine resin particle mixture was prepared.

Then, 100 parts by weight of toner base particles and the fine resin particle mixture obtained above were inputted into a surface modifying apparatus equipped with a two-fluid nozzle capable of spraying a spray liquid in a container (trade name: Hybridizer NHS-1 Model, manufactured by Nara Machinery Co., Ltd.), and fluidized at a rotation speed of 8000 rpm for 10 minutes. Compressed air was sent to the two-fluid nozzle to set such that ethanol as a spray liquid is sprayed in 0.5 g/min, and the ethanol was sprayed at 45° C. for 40 minutes. The fine resin particles A and the fine resin particles B, on the surfaces of the toner base particles were formed into a film.

The toner base particles on which the fine resin particles were formed into a film were dried, and a capsule toner of Example 1 comprising the toner base particles having a resin coating layer formed on the entire surface thereof was obtained. The capsule toner of Example 1 had a volume average particle size of 7.3 μm and a coefficient of variation of 27.

Examples 2 to 14

Capsule toners of Examples 2 to 14 were obtained in the same manner as in Example 1, except for changing kinds and addition amounts of the low viscosity fine resin particles and the high viscosity fine resin particles as shown in Table 2 below.

Example 15

In Example 15, the fine resin particles A were used as low viscosity fine resin particles, and the fine resin particles B were used as high viscosity fine resin particles.

Then, 10 wt % suspension obtained by dispersing 5 parts by weight of the fine resin particles A was dried with a spray drier. Further, 10 wt % suspension obtained by dispersing 5 parts by weight of the fine resin particles B was dried with a spray drier.

Into a surface modifying apparatus equipped with a two-fluid nozzle capable of spraying a spray liquid in a container (trade name: Hybridizer NHS-1 Model, manufactured by Nara Machinery Co., Ltd.), 100 parts by weight of toner base particles and the fine resin particles A and B having been subjected to drying treatment were inputted, and fluidized at a rotation speed of 8000 rpm for 10 minutes. Compressed air was sent to the two-fluid nozzle to set such that ethanol as a spray liquid is sprayed in 0.5 g/min, and the ethanol was sprayed at 45° C. for 40 minutes. The fine resin particles A and the fine resin particles B, on the surface of the toner base particles were film-formed.

The toner base particles on which the fine resin particles were formed into a film were dried, and a capsule toner of Example 15 comprising the toner base particles having a resin coating layer formed on the entire surface thereof was obtained. The capsule toner of Example 15 had a volume average particle size of 7.2 μl and a coefficient of variation of 27.

Comparative Example 1

A capsule toner of Comparative Example 1 was obtained in the same manner as in Example 1, except for changing the amount of the fine resin particles A added from 5 parts by weight to 10 parts by weight and not using the fine resin particles B. The capsule toner of Comparative Example 1 had a volume average particle size of 7.2 μm and a coefficient of variation of 25.

Comparative Example 2

A capsule toner of Comparative Example 2 was obtained in the same manner as in Example 1, except for changing the amount of the fine resin particles B added from 5 parts by weight to 10 parts by weight and not using the fine resin particles A. The capsule toner of Comparative Example 2 had a volume average particle size of 7.2 μm and a coefficient of variation of 26.

Comparative Example 3

With a spray drier, 10 wt % suspension prepared by dispersing 10 parts by weight of the fine resin particles C was dried.

A capsule toner of Comparative Example 3 was obtained in the same manner as in Example 1, except for using the fine resin particles C obtained above in place of the fine resin particle mixture containing the fine resin particles A and the fine resin particles B. The capsule toner of Comparative Example 3 had a volume average particle size of 7.0 μm and a coefficient of variation of 25.

With regard to the capsule toners of Examples 1 to 15 and Comparative Examples 1 to 3, Table 2 shows kinds and addition amounts of the low viscosity fine resin particles and the high viscosity fine resin particles, addition proportion of the low viscosity fine resin particles to the whole amount of the fine resin particles, addition proportion of the high viscosity fine resin particles to the whole amount of the fine resin particles, ratio of complex viscosity $\eta_2$ of the high viscosity fine resin particles to complex viscosity $\eta_1$ of the low viscosity fine resin particles, kind of the spray liquid, and volume average particle size and variation coefficient of capsule toners.

TABLE 2

| | Low viscosity fine resin particle | | | | High viscosity fine resin particle | | | | | | Capsule toner | |
|---|---|---|---|---|---|---|---|---|---|---|---|---|
| | Kind | Complex viscosity (Pa · s) | Addition amount (parts by weight) | Addition proportion (%) | Kind | Complex viscosity (Pa · s) | Addition amount (parts by weight) | Addition proportion (%) | Ratio of complex viscosities $\eta_2/\eta_1$ | Spray liquid | Volume average particle size (μm) | Variation coefficient |
| Example 1 | A | $8.0 \times 10^2$ | 5 | 50 | B | $4.0 \times 10^4$ | 5 | 50 | 50 | Ethanol | 7.3 | 27 |
| Example 2 | A | $8.0 \times 10^2$ | 7 | 70 | B | $4.0 \times 10^4$ | 3 | 30 | 50 | Ethanol | 7.2 | 25 |
| Example 3 | A | $8.0 \times 10^2$ | 3 | 30 | B | $4.0 \times 10^4$ | 7 | 70 | 50 | Ethanol | 7.1 | 25 |
| Example 4 | A | $8.0 \times 10^2$ | 9 | 90 | B | $4.0 \times 10^4$ | 1 | 10 | 50 | Ethanol | 7.2 | 27 |
| Example 5 | A | $8.0 \times 10^2$ | 1 | 10 | B | $4.0 \times 10^4$ | 9 | 90 | 50 | Ethanol | 7.3 | 27 |
| Example 6 | D | $4.5 \times 10^2$ | 5 | 50 | B | $4.0 \times 10^4$ | 5 | 50 | 89 | Ethanol | 7.3 | 26 |
| Example 7 | E | $1.2 \times 10^3$ | 5 | 50 | B | $4.0 \times 10^4$ | 5 | 50 | 33 | Ethanol | 7.1 | 24 |
| Example 8 | A | $8.0 \times 10^2$ | 5 | 50 | F | $9.5 \times 10^3$ | 5 | 50 | 12 | Ethanol | 7.3 | 26 |
| Example 9 | A | $8.0 \times 10^2$ | 5 | 50 | G | $1.2 \times 10^5$ | 5 | 50 | 150 | Ethanol | 7.2 | 25 |
| Example 10 | D | $4.5 \times 10^2$ | 5 | 50 | H | $1.0 \times 10^5$ | 5 | 50 | 222 | Ethanol | 7.3 | 25 |
| Example 11 | E | $1.2 \times 10^3$ | 5 | 50 | I | $1.0 \times 10^4$ | 5 | 50 | 8 | Ethanol | 7.1 | 24 |
| Example 12 | E | $1.2 \times 10^3$ | 5 | 50 | G | $1.2 \times 10^5$ | 5 | 50 | 100 | Ethanol | 7.1 | 26 |
| Example 13 | A | $8.0 \times 10^2$ | 2.5 | 25 | B | $4.0 \times 10^4$ | 7.5 | 75 | 50 | Ethanol | 7.2 | 25 |
| Example 14 | A | $8.0 \times 10^2$ | 7.5 | 75 | B | $4.0 \times 10^4$ | 2.5 | 25 | 50 | Ethanol | 7.1 | 26 |
| Example 15 | A | $8.0 \times 10^2$ | 5 | 50 | B | $4.0 \times 10^4$ | 5 | 50 | 50 | Ethanol | 7.2 | 27 |
| Comparative Example 1 | A | $8.0 \times 10^2$ | 10 | 100 | — | — | 0 | 0 | — | Ethanol | 7.2 | 25 |
| Comparative Example 2 | — | — | 0 | 0 | B | $4.0 \times 10^4$ | 10 | 100 | — | Ethanol | 7.2 | 26 |
| Comparative Example 3 | 10 parts by weight of fine resin particles C were added | | | | | | | | | Ethanol | 7.0 | 25 |

<Preparation of Two-Component Developer>

With 100 parts by weight of each capsule toner obtained in the Examples and the Comparative Examples above, 0.7 parts by weight of silica particles having an average primary particle size of 20 nm hydrophocized with a silane coupling agent and 1 part by weight of titanium oxide were mixed. The resulting external-addition-treated toner and a ferrite core carrier having a volume average particle size of 60 μm were mixed such that the concentration of the external-addition-treated toner to the whole amount of a two-component developer is 7%. Thus, a two-component developer having a toner concentration of 7% was prepared.

Using each of the two-component developers obtained above, fixability was evaluated as follows.

[Fixability]

Using a copying machine obtained by modifying the commercially available copying machine (trade name: MX-450, manufactured by Sharp Corporation), a fixed image by the above two-component developer was prepared. A sample image containing a solid image area (rectangular having 20 mm long and 50 mm wide) was formed as an unfixed image on a recording paper sheet (trade name: PPC Paper SF-4AM3, manufactured by Sharp Corporation) as a recording medium. In this case, the amount of the capsule toner adhered to the recording paper sheet in the solid image area was adjusted to be 0.5 mg/cm$^2$.

A fixed image was prepared using an external fixing instrument utilizing a fixing section of the copying machine. Fixing process speed was 124 mm/sec, temperature of a fixing roller was elevated at 5° C. intervals from 130° C., temperature region that does not cause low temperature offset and high temperature offset was obtained, and its temperature width was used as a fixing non-offset region. The high temperature offset and low temperature offset are defined that capsule toner does not fix to a recording paper sheet during fixing, and adheres to a recording paper sheet after the fixing roller has gone round with the capsule toner remain adhered thereto. The fixing non-offset range was obtained by the following expression (2):

$$\text{Fixing non-offset range (° C.)} = \text{Fixing upper limit temperature (° C.)} - \text{Fixing lower limit temperature (° C.)} \quad (2)$$

Evaluation standard of fixability is as follows.

Excellent: Very favorable. Fixing non-offset range is 50° C. or higher.

Good: Favorable. Fixing non-offset range is 35° C. or higher and lower than 50° C.

Not bad: Slightly poor. Fixing non-offset range is 25° C. or higher and lower than 35° C.

Poor: No good. Fixing non-offset range is lower than 25° C.

The evaluation results of fixability are shown in Table 3.

TABLE 3

| | Fixability | | | |
|---|---|---|---|---|
| | Fixing lower limit temperature (° C.) | Fixing upper limit temperature (° C.) | Fixing non-offset range (° C.) | Evaluation |
| Example 1 | 150 | 200 | 50 | Excellent |
| Example 2 | 150 | 200 | 50 | Excellent |
| Example 3 | 150 | 200 | 50 | Excellent |
| Example 4 | 150 | 190 | 40 | Good |
| Example 5 | 160 | 200 | 40 | Good |
| Example 6 | 150 | 195 | 45 | Good |
| Example 7 | 155 | 200 | 45 | Good |
| Example 8 | 150 | 195 | 45 | Good |
| Example 9 | 155 | 200 | 45 | Good |
| Example 10 | 150 | 195 | 45 | Good |
| Example 11 | 155 | 200 | 45 | Good |
| Example 12 | 165 | 200 | 35 | Good |
| Example 13 | 155 | 200 | 45 | Good |
| Example 14 | 140 | 195 | 45 | Good |
| Example 15 | 155 | 195 | 40 | Good |
| Comparative Example 1 | 150 | 180 | 30 | Not bad |
| Comparative Example 2 | 170 | 200 | 30 | Not bad |
| Comparative Example 3 | 160 | 190 | 30 | Not bad |

As shown in Table 3, the capsule toners of Examples 1 to 15 had good fixability. However, the capsule toners of Examples 4, 5, 13 and 14 in which the addition amount of the low viscosity fine resin particles to the total amount of the fine resin particles fell outside the preferred range of 30% by weight or more and 70% by weight or less showed relatively high fixing lower limit temperature and slightly decreased low temperature fixability, or showed relatively low upper limit temperature and slightly decreased hot offset resistance. The capsule toners of Examples 6 to 11 in which the complex viscosity of the low viscosity fine resin particles fell outside the preferred range of $5.0\times10^2$ Pa·s or more and $1.0\times10^3$ Pa·s or less, or the complex viscosity of the high viscosity fine resin particles fell outside the preferred range of $1.0\times10^4$ Pa·s or more and $1.0\times10^5$ Pa·s or less showed slightly decreased low temperature fixability or hot offset resistance. Example 12 in which the complex viscosities of the low viscosity fine resin particles and the high viscosity fine resin particles were higher than the above preferred range showed decreased low temperature fixability. Example 15 in which fine resin particle mixture was not used showed slightly decreased fixability and hot offset resistance.

Comparative Example 1 that did not contain high viscosity fine resin particles showed decreased hot offset resistance. Comparative Example 2 that did not contain low viscosity fine resin particles showed decreased low temperature fixability. Comparative Example 3 that did not use plural fine resin particles having different complex viscosities showed small fixing non-offset range.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a capsule toner comprising a toner base particle comprising a binder resin and a colorant, and a resin coating layer formed on the surface of the toner base particle, the method comprising:

a fine resin particle adhering step of adhering plural fine resin particles having different complex viscosities at a softening temperature of the toner base particle to the surface of the toner base particle by fluidizing the toner base particles and the plural fine resin particles by using a rotary stirring apparatus comprising a rotary stirring section and a spraying section and rotating the rotary stirring section;

a spraying step of spraying a spray liquid being a liquid for plasticizing the toner base particle and the plural fine resin particles, to the toner base particle having the plural fine resin particles adhered thereto, in a fluidized state from the spraying section by continuing rotation of the rotary stirring section; and a film-forming step of forming a resin coating film on the surface of the toner base particle by continuing rotation of the rotary stirring section until the plural fine resin particles adhered to the toner base particle are softened and form a film.

2. The method of claim 1, wherein the plural fine resin particles comprise:

first fine resin particles having the complex viscosity at a softening temperature of the toner base particle of $5.0\times10^2$ Pa·s or more and $1.0\times10^3$ Pa·s or less; and second fine resin particles having the complex viscosity at a softening temperature of the toner base particle of $1.0\times10^4$ Pa·s or more and $1.0\times10^5$ Pa·s or less, and a ratio ($\eta_2/\eta_1$) of the complex viscosity $\eta_2$ to the complex viscosity $\eta_1$ is 10 or more and 200 or less, where $\eta_1$ denotes the complex viscosity at a softening temperature of the toner base particle of the first fine resin particles and $\eta_2$ denotes the complex viscosity at a softening temperature of the toner base particle of the second fine resin particles.

3. The method of claim 2, wherein the fine resin particle adhering step comprises:

a first mixing step of obtaining fine resin particle mixture by fluidizing the first fine resin particles and the second fine resin particles; and a second mixing step of adhering the fine resin particle mixture to the surfaces of the toner base particle by fluidizing the toner base particle and the fine resin particle mixture.

4. The method of claim 3, wherein the first fine resin particles are mixed in the first mixing step such that the amount of the first fine resin particles is 30% by weight or more and 70% by weight or less based on the total weight of the fine resin particle mixture.

* * * * *